US010966295B2

(12) United States Patent
Ivey et al.

(10) Patent No.: US 10,966,295 B2
(45) **Date of Patent: *Mar. 30, 2021**

(54) SYSTEM AND METHOD FOR CONTROLLING OPERATION OF AN LED-BASED LIGHT

(71) Applicant: iLumisys, Inc., Troy, MI (US)

(72) Inventors: John Ivey, Farmington Hills, MI (US); David L. Simon, Grosse Pointe Woods, MI (US); Hoan Ngo, Sterling Height, MI (US); Anthony J. Norton, Ann Arbor, MI (US); Brian Nickol, Macomb, MI (US)

(73) Assignee: iLumisys, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/390,418

(22) Filed: Apr. 22, 2019

(65) Prior Publication Data

US 2019/0254138 A1 Aug. 15, 2019

Related U.S. Application Data

(63) Continuation of application No. 15/712,701, filed on Sep. 22, 2017, now Pat. No. 10,278,247, which is a (Continued)

(51) Int. Cl.
*H05B 47/175* (2020.01)
*H05B 47/155* (2020.01)

(Continued)

(52) U.S. Cl.
CPC ..... *H05B 45/10* (2020.01); *H05B 45/00* (2020.01); *H05B 47/155* (2020.01); *H05B 47/175* (2020.01); *H05B 47/19* (2020.01)

(58) Field of Classification Search
CPC ..... H05B 33/0854; H05B 33/0803; H05B 37/0245; H05B 37/0272; H05B 37/029
See application file for complete search history.

(56) References Cited

U.S. PATENT DOCUMENTS

D79,814 S 11/1929 Hoch
D80,419 S 1/1930 Kramer (Continued)

FOREIGN PATENT DOCUMENTS

CN 1584388 2/2005
CN 2766345 3/2006

(Continued)

OTHER PUBLICATIONS

Airport International. Fly High With Intelligent Airport Building and Security Solutions [online], [retrieved on Oct. 24, 2008]. Retrieved from Airport International web page = using Internet <URL: http://www.airport-int.com/ categories/airport-building-and-security solutions/fly-high-with-intelligent-airport-building-and-security-solutions.html>.

(Continued)

*Primary Examiner* — Henry Luong
(74) *Attorney, Agent, or Firm* — Fish & Richardson P.C.

(57) ABSTRACT

For controlling operation of a light source, a method of associating a light source with an area for which the light source is positioned to provide lighting comprises: identifying, based on a determined physical position of a light source, one of a plurality of areas as the area for which the light source is positioned to provide lighting; identifying at least one desired lighting condition for the identified area; and controlling, using a processor, operation of the light source based on the identified at least one desired lighting condition for the identified area.

29 Claims, 3 Drawing Sheets

Related U.S. Application Data continuation of application No. 15/008,864, filed on Jan. 28, 2016, now Pat. No. 9,807,842, which is a continuation of application No. 13/934,607, filed on Jul. 3, 2013, now Pat. No. 9,271,367.

(60) Provisional application No. 61/669,319, filed on Jul. 9, 2012.

(51) Int. Cl.

| | |
|---|---|
| ***H05B 47/10*** | (2020.01) |
| ***H05B 45/10*** | (2020.01) |
| ***H05B 45/00*** | (2020.01) |
| ***H05B 47/19*** | (2020.01) |

(56) References Cited

U.S. PATENT DOCUMENTS

| | | | |
|---|---|---|---|
| D84,763 | S | 7/1931 | Stange |
| D119,797 | S | 4/1940 | Winkler et al. |
| D125,312 | S | 2/1941 | Logan |
| 2,826,679 | A | 3/1958 | Rosenburg |
| 2,909,097 | A | 10/1959 | Alden et al. |
| 3,178,622 | A | 4/1965 | Paul et al. |
| 3,272,977 | A | 9/1966 | Holmes |
| 3,318,185 | A | 5/1967 | Hermann |
| 3,561,719 | A | 2/1971 | Grindle |
| 3,586,936 | A | 6/1971 | McLeroy |
| 3,601,621 | A | 8/1971 | Ritchie |
| 3,612,855 | A | 10/1971 | Juhnke |
| 3,643,088 | A | 2/1972 | Osteen et al. |
| 3,739,336 | A | 6/1973 | Burland |
| 3,746,918 | A | 7/1973 | Drucker et al. |
| 3,818,216 | A | 6/1974 | Larraburu |
| 3,832,503 | A | 8/1974 | Crane |
| 3,858,086 | A | 12/1974 | Anderson et al. |
| 3,909,670 | A | 9/1975 | Wakamatsu et al. |
| 3,924,120 | A | 12/1975 | Cox, III |
| 3,958,885 | A | 5/1976 | Stockinger et al. |
| 3,969,720 | A | 7/1976 | Nishino |
| 3,974,637 | A | 8/1976 | Bergey et al. |
| 3,993,386 | A | 11/1976 | Rowe |
| 4,001,571 | A | 1/1977 | Martin |
| 4,054,814 | A | 10/1977 | Fegley et al. |
| 4,070,568 | A | 1/1978 | Gala |
| 4,082,395 | A | 4/1978 | Donato et al. |
| 4,096,349 | A | 6/1978 | Donato |
| 4,102,558 | A | 7/1978 | Krachman |
| 4,107,581 | A | 8/1978 | Abernethy |
| 4,189,663 | A | 2/1980 | Schmutzer et al. |
| 4,211,955 | A | 7/1980 | Ray |
| 4,241,295 | A | 12/1980 | Williams, Jr. |
| 4,261,029 | A | 4/1981 | Mousset |
| 4,262,255 | A | 4/1981 | Kokei et al. |
| 4,271,408 | A | 6/1981 | Teshima et al. |
| 4,271,458 | A | 6/1981 | George, Jr. |
| 4,272,689 | A | 6/1981 | Crosby et al. |
| 4,273,999 | A | 6/1981 | Pierpoint |
| 4,298,869 | A | 11/1981 | Okuno |
| 4,329,625 | A | 5/1982 | Niskizawa et al. |
| 4,339,788 | A | 7/1982 | White et al. |
| 4,342,947 | A | 8/1982 | Bloyd |
| 4,344,117 | A | 8/1982 | Niccum |
| 4,367,464 | A | 1/1983 | Kurahashi et al. |
| D268,134 | S | 3/1983 | Zurcher |
| 4,382,272 | A | 5/1983 | Quelle et al. |
| 4,388,567 | A | 6/1983 | Yamazaki et al. |
| 4,388,589 | A | 6/1983 | Molldrem, Jr. |
| 4,392,187 | A | 7/1983 | Bornhorst |
| 4,394,719 | A | 7/1983 | Moberg |
| 4,420,711 | A | 12/1983 | Takahashi et al. |
| 4,455,562 | A | 6/1984 | Dolan et al. |
| 4,500,796 | A | 2/1985 | Quin |
| 4,521,835 | A | 6/1985 | Meggs et al. |
| 4,531,114 | A | 7/1985 | Topol et al. |
| 4,581,687 | A | 4/1986 | Nakanishi |
| 4,597,033 | A | 6/1986 | Meggs et al. |
| 4,600,972 | A | 7/1986 | MacIntyre |
| 4,607,317 | A | 8/1986 | Lin |
| 4,622,881 | A | 11/1986 | Rand |
| 4,625,152 | A | 11/1986 | Nakai |
| 4,635,052 | A | 1/1987 | Aoike et al. |
| 4,647,217 | A | 3/1987 | Havel |
| 4,650,971 | A | 3/1987 | Manecci et al. |
| 4,656,398 | A | 4/1987 | Michael et al. |
| 4,661,890 | A | 4/1987 | Watanabe et al. |
| 4,668,895 | A | 5/1987 | Schneiter |
| 4,669,033 | A | 5/1987 | Lee |
| 4,675,575 | A | 6/1987 | Smith et al. |
| 4,682,079 | A | 7/1987 | Sanders et al. |
| 4,686,425 | A | 8/1987 | Havel |
| 4,687,340 | A | 8/1987 | Havel |
| 4,688,154 | A | 8/1987 | Nilssen |
| 4,688,869 | A | 8/1987 | Kelly |
| 4,695,769 | A | 9/1987 | Schweickardt |
| 4,698,730 | A | 10/1987 | Sakai et al. |
| 4,701,669 | A | 10/1987 | Head et al. |
| 4,705,406 | A | 11/1987 | Havel |
| 4,707,141 | A | 11/1987 | Havel |
| D293,723 | S | 1/1988 | Buttner |
| 4,727,289 | A | 2/1988 | Uchida |
| 4,739,454 | A | 4/1988 | Federgreen |
| 4,740,882 | A | 4/1988 | Miller |
| 4,748,545 | A | 5/1988 | Schmitt |
| 4,753,148 | A | 6/1988 | Johnson |
| 4,758,173 | A | 7/1988 | Northrop |
| 4,765,708 | A | 8/1988 | Becker et al. |
| 4,771,274 | A | 9/1988 | Havel |
| 4,780,621 | A | 10/1988 | Bartleucc et al. |
| 4,794,373 | A | 12/1988 | Harrison |
| 4,794,383 | A | 12/1988 | Havel |
| 4,801,928 | A | 1/1989 | Minter |
| 4,810,937 | A | 3/1989 | Havel |
| 4,818,072 | A | 4/1989 | Mohebban |
| 4,824,269 | A | 4/1989 | Havel |
| 4,837,565 | A | 6/1989 | White |
| 4,843,627 | A | 6/1989 | Stebbins |
| 4,845,481 | A | 7/1989 | Havel |
| 4,845,745 | A | 7/1989 | Havel |
| 4,847,536 | A | 7/1989 | Lowe et al. |
| 4,851,972 | A | 7/1989 | Altman |
| 4,854,701 | A | 8/1989 | Noll et al. |
| 4,857,801 | A | 8/1989 | Farrell |
| 4,863,223 | A | 9/1989 | Weissenbach et al. |
| 4,870,325 | A | 9/1989 | Kazar |
| 4,874,320 | A | 10/1989 | Freed et al. |
| 4,887,074 | A | 12/1989 | Simon et al. |
| 4,894,832 | A | 1/1990 | Colak |
| 4,901,207 | A | 2/1990 | Sato et al. |
| 4,904,988 | A | 2/1990 | Nesbit et al. |
| 4,912,371 | A | 3/1990 | Hamilton |
| 4,920,459 | A | 4/1990 | Rothwell et al. |
| 4,922,154 | A | 5/1990 | Cacoub |
| 4,929,936 | A | 5/1990 | Friedman et al. |
| 4,934,852 | A | 6/1990 | Havel |
| 4,941,072 | A | 7/1990 | Yasumoto et al. |
| 4,943,900 | A | 7/1990 | Gartner |
| 4,962,687 | A | 10/1990 | Belliveau et al. |
| 4,965,561 | A | 10/1990 | Havel |
| 4,973,835 | A | 11/1990 | Kurosu et al. |
| 4,977,351 | A | 12/1990 | Bavaro et al. |
| 4,979,081 | A | 12/1990 | Leach et al. |
| 4,979,180 | A | 12/1990 | Muncheryan |
| 4,980,806 | A | 12/1990 | Taylor et al. |
| 4,991,070 | A | 2/1991 | Stob |
| 4,992,704 | A | 2/1991 | Stinson |
| 5,003,227 | A | 3/1991 | Nilssen |
| 5,008,595 | A | 4/1991 | Kazar |
| 5,008,788 | A | 4/1991 | Palinkas |
| 5,010,459 | A | 4/1991 | Taylor et al. |
| 5,018,054 | A | 5/1991 | Ohashi et al. |
| 5,027,037 | A | 6/1991 | Wei |
| 5,027,262 | A | 6/1991 | Freed |
| 5,032,960 | A | 7/1991 | Katoh |

(56) References Cited

U.S. PATENT DOCUMENTS 5,034,807 A 7/1991 Von Kohorn
5,036,248 A 7/1991 McEwan et al.
5,038,255 A 8/1991 Nishihashi et al.
5,065,226 A 11/1991 Kluitmans et al.
5,072,216 A 12/1991 Grange
5,078,039 A 1/1992 Tulk et al.
5,083,063 A 1/1992 Brooks
5,088,013 A 2/1992 Revis
5,089,748 A 2/1992 Ihms
5,103,382 A 4/1992 Kondo et al.
5,122,733 A 6/1992 Havel
5,126,634 A 6/1992 Johnson
5,128,595 A 7/1992 Hara
5,130,909 A 7/1992 Gross
5,134,387 A 7/1992 Smith et al.
5,136,483 A 8/1992 Schoniger et al.
5,140,220 A 8/1992 Hasegawa
5,142,199 A 8/1992 Elwell
5,151,679 A 9/1992 Dimmick
5,154,641 A 10/1992 Mclaughlin
5,161,879 A 11/1992 McDermott
5,161,882 A 11/1992 Garrett
5,164,715 A 11/1992 Kashiwabara et al.
5,184,114 A 2/1993 Brown
5,194,854 A 3/1993 Havel
5,198,756 A 3/1993 Jenkins et al.
5,209,560 A 5/1993 Taylor et al.
5,220,250 A 6/1993 Szuba
5,225,765 A 7/1993 Callahan et al.
5,226,723 A 7/1993 Chen
5,254,910 A 10/1993 Yang
5,256,948 A 10/1993 Boldin et al.
5,278,542 A 1/1994 Smith et al.
5,281,961 A 1/1994 Elwell
5,282,121 A 1/1994 Bornhorst et al.
5,283,517 A 2/1994 Havel
5,287,352 A 2/1994 Jackson et al.
5,294,865 A 3/1994 Haraden
5,298,871 A 3/1994 Shimohara
5,301,090 A 4/1994 Hed
5,303,124 A 4/1994 Wrobel
5,307,295 A 4/1994 Taylor et al.
5,321,593 A 6/1994 Moates
5,323,226 A 6/1994 Schreder
5,329,431 A 7/1994 Taylor et al.
5,341,988 A 8/1994 Rein et al.
5,344,068 A 9/1994 Haessig
5,350,977 A 9/1994 Hamamoto et al.
5,357,170 A 10/1994 Luchaco et al.
5,365,411 A 11/1994 Rycroft et al.
5,371,618 A 12/1994 Tai et al.
5,374,876 A 12/1994 Horibata et al.
5,375,043 A 12/1994 Tokunaga
D354,360 S 1/1995 Murata
5,381,074 A 1/1995 Rudzewicz et al.
5,388,357 A 2/1995 Malita
5,402,702 A 4/1995 Hata
5,404,094 A 4/1995 Green et al.
5,404,282 A 4/1995 Klinke et al.
5,406,176 A 4/1995 Sugden
5,410,328 A 4/1995 Yoksza et al.
5,412,284 A 5/1995 Moore et al.
5,412,552 A 5/1995 Fernandes
5,420,482 A 5/1995 Phares
5,421,059 A 6/1995 Leffers, Jr.
5,430,356 A 7/1995 Ference et al.
5,432,408 A 7/1995 Matsuda et al.
5,436,535 A 7/1995 Yang
5,436,853 A 7/1995 Shimohara
5,450,301 A 9/1995 Waltz et al.
5,461,188 A 10/1995 Drago et al.
5,463,280 A 10/1995 Johnson
5,463,502 A 10/1995 Savage, Jr.
5,465,144 A 11/1995 Parker et al.
5,473,522 A 12/1995 Kriz et al.
5,475,300 A 12/1995 Havel
5,481,441 A 1/1996 Stevens
5,489,827 A 2/1996 Xia
5,491,402 A 2/1996 Small
5,493,183 A 2/1996 Kimball
5,504,395 A 4/1996 Johnson et al.
5,506,760 A 4/1996 Giebler et al.
5,513,082 A 4/1996 Asano
5,519,496 A 5/1996 Borgert et al.
5,530,322 A 6/1996 Ference et al.
5,539,628 A 7/1996 Seib
5,544,809 A 8/1996 Keating et al.
5,545,950 A 8/1996 Cho
5,550,440 A 8/1996 Allison et al.
5,559,681 A 9/1996 Duarte
5,561,346 A 10/1996 Byrne
D376,030 S 11/1996 Cohen
5,575,459 A 11/1996 Anderson
5,575,554 A 11/1996 Guritz
5,581,158 A 12/1996 Quazi
5,592,051 A 1/1997 Korkala
5,592,054 A 1/1997 Nerone et al.
5,600,199 A 2/1997 Martin, Sr. et al.
5,607,227 A 3/1997 Yasumoto et al.
5,608,290 A 3/1997 Hutchisson et al.
5,614,788 A 3/1997 Mullins et al.
5,621,282 A 4/1997 Haskell
5,621,603 A 4/1997 Adamec et al.
5,621,662 A 4/1997 Humphries et al.
5,622,423 A 4/1997 Lee
5,633,629 A 5/1997 Hochstein
5,634,711 A 6/1997 Kennedy et al.
5,640,061 A 6/1997 Bornhorst et al.
5,640,141 A 6/1997 Myllymaki
5,642,129 A 6/1997 Zavracky et al.
5,655,830 A 8/1997 Ruskouski
5,656,935 A 8/1997 Havel
5,661,374 A 8/1997 Cassidy et al.
5,661,645 A 8/1997 Hochstein
5,673,059 A 9/1997 Zavracky et al.
5,682,103 A 10/1997 Burrell
5,684,523 A 11/1997 Satoh et al.
5,688,042 A 11/1997 Madadi et al.
5,697,695 A 12/1997 Lin et al.
5,701,058 A 12/1997 Roth
5,712,650 A 1/1998 Barlow
5,713,655 A 2/1998 Blackman
5,721,471 A 2/1998 Begemann et al.
5,725,148 A 3/1998 Hartman
5,726,535 A 3/1998 Yan
5,731,759 A 3/1998 Finucan
5,734,590 A 3/1998 Tebbe
5,751,118 A 5/1998 Mortimer
5,752,766 A 5/1998 Bailey et al.
5,765,940 A 6/1998 Levy et al.
5,769,527 A 6/1998 Taylor et al.
5,781,108 A 7/1998 Jacob et al.
5,784,006 A 7/1998 Hochstein
5,785,227 A 7/1998 Akiba
5,790,329 A 8/1998 Klaus et al.
5,803,579 A 9/1998 Turnbull et al.
5,803,580 A 9/1998 Tseng
5,803,729 A 9/1998 Tsimerman
5,806,965 A 9/1998 Deese
5,810,463 A 9/1998 Small
5,812,105 A 9/1998 Kawahara et al.
5,813,751 A 9/1998 Van de Ven
5,813,753 A 9/1998 Shaffer
5,821,695 A 9/1998 Vriens et al.
5,825,051 A 10/1998 Vilanilam et al.
5,828,178 A 10/1998 Bauer et al.
5,831,522 A 10/1998 York et al.
5,836,676 A 11/1998 Wood et al.
5,841,177 A 11/1998 Komoto et al.
5,848,837 A 11/1998 Ando et al.
5,850,126 A 12/1998 Gustafson
5,851,063 A 12/1998 Kanbar
5,852,658 A 12/1998 Doughty et al.
5,854,542 A 12/1998 Knight et al.

(56) References Cited

U.S. PATENT DOCUMENTS

| | | | |
|---|---|---|---|
| RE36,030 | E | 1/1999 | Nadeau |
| 5,859,508 | A | 1/1999 | Ge et al. |
| 5,865,529 | A | 1/1999 | Ge et al. |
| 5,890,794 | A | 2/1999 | Yan |
| 5,896,010 | A | 4/1999 | Abtahi et al. |
| 5,904,415 | A | 4/1999 | Mikolajczak et al. |
| 5,907,742 | A | 5/1999 | Robertson et al. |
| 5,909,378 | A | 5/1999 | Johnson et al. |
| 5,912,653 | A | 6/1999 | De Milleville |
| 5,917,287 | A | 6/1999 | Fitch |
| 5,917,534 | A | 6/1999 | Haederle et al. |
| 5,921,660 | A | 6/1999 | Rajeswaran |
| 5,924,784 | A | 7/1999 | Yu |
| 5,927,845 | A | 7/1999 | Chliwnyj et al. |
| 5,934,792 | A | 7/1999 | Gustafson et al. |
| 5,936,599 | A | 8/1999 | Camarota |
| 5,943,802 | A | 8/1999 | Reymond |
| 5,946,209 | A | 8/1999 | Tijanic |
| 5,949,347 | A | 8/1999 | Eckel et al. |
| 5,951,145 | A | 9/1999 | Iwasaki et al. |
| 5,952,680 | A | 9/1999 | Strite |
| 5,959,547 | A | 9/1999 | Tubel et al. |
| 5,961,072 | A | 10/1999 | Bodle |
| 5,962,989 | A | 10/1999 | Baker |
| 5,962,992 | A | 10/1999 | Huang et al. |
| 5,963,185 | A | 10/1999 | Havel |
| 5,966,069 | A | 10/1999 | Zmurk et al. |
| 5,971,597 | A | 10/1999 | Baldwin et al. |
| 5,973,594 | A | 10/1999 | Baldwin et al. |
| 5,974,553 | A | 10/1999 | Gandar |
| 5,980,064 | A | 11/1999 | Metroyanis |
| 5,998,925 | A | 12/1999 | Shimizu et al. |
| 5,998,928 | A | 12/1999 | Hipp |
| 6,000,807 | A | 12/1999 | Moreland |
| 6,007,209 | A | 12/1999 | Pelka |
| 6,008,783 | A | 12/1999 | Kitagawa et al. |
| 6,010,228 | A | 1/2000 | Blackman et al. |
| 6,011,691 | A | 1/2000 | Schreffler |
| 6,016,038 | A | 1/2000 | Mueller et al. |
| 6,018,237 | A | 1/2000 | Havel |
| 6,019,493 | A | 2/2000 | Kuo et al. |
| 6,020,825 | A | 2/2000 | Chansky et al. |
| 6,025,550 | A | 2/2000 | Kato |
| 6,028,694 | A | 2/2000 | Schmidt |
| 6,030,099 | A | 2/2000 | McDermott |
| 6,031,343 | A | 2/2000 | Recknagel et al. |
| D422,737 | S | 4/2000 | Crozco |
| 6,056,420 | A | 5/2000 | Wilson et al. |
| 6,068,383 | A | 5/2000 | Robertson et al. |
| 6,069,597 | A | 5/2000 | Hansen |
| 6,072,280 | A | 6/2000 | Allen |
| 6,074,074 | A | 6/2000 | Marcus |
| 6,084,359 | A | 7/2000 | Hetzel et al. |
| 6,086,220 | A | 7/2000 | Lash et al. |
| 6,091,200 | A | 7/2000 | Lenz |
| 6,092,915 | A | 7/2000 | Rensch |
| 6,095,661 | A | 8/2000 | Lebens et al. |
| 6,097,352 | A | 8/2000 | Zavracky et al. |
| 6,107,755 | A | 8/2000 | Katyl et al. |
| 6,116,748 | A | 9/2000 | George |
| 6,121,875 | A | 9/2000 | Hamm et al. |
| 6,127,783 | A | 10/2000 | Pashley et al. |
| 6,132,072 | A | 10/2000 | Turnbull et al. |
| 6,135,604 | A | 10/2000 | Lin |
| 6,135,620 | A | 10/2000 | Marsh |
| 6,139,174 | A | 10/2000 | Butterworth |
| 6,149,283 | A | 11/2000 | Conway et al. |
| 6,150,774 | A | 11/2000 | Mueller et al. |
| 6,151,529 | A | 11/2000 | Batko |
| 6,153,985 | A | 11/2000 | Grossman |
| 6,158,882 | A | 12/2000 | Bischoff, Jr. |
| 6,166,496 | A | 12/2000 | Lys et al. |
| 6,175,201 | B1 | 1/2001 | Sid |
| 6,175,220 | B1 | 1/2001 | Billig et al. |
| 6,181,126 | B1 | 1/2001 | Havel |
| D437,947 | S | 2/2001 | Huang |
| 6,183,086 | B1 | 2/2001 | Neubert |
| 6,183,104 | B1 | 2/2001 | Ferrara |
| 6,184,628 | B1 | 2/2001 | Ruthenberg |
| 6,196,471 | B1 | 3/2001 | Ruthenberg |
| 6,211,626 | B1 | 4/2001 | Lys et al. |
| 6,215,409 | B1 | 4/2001 | Blach |
| 6,217,190 | B1 | 4/2001 | Altman et al. |
| 6,219,239 | B1 | 4/2001 | Mellberg et al. |
| 6,220,722 | B1 | 4/2001 | Begemann |
| 6,227,679 | B1 | 5/2001 | Zhang et al. |
| 6,238,075 | B1 | 5/2001 | Dealey et al. |
| 6,241,359 | B1 | 6/2001 | Lin |
| 6,249,221 | B1 | 6/2001 | Reed |
| 6,250,774 | B1 | 6/2001 | Begemann et al. |
| 6,252,350 | B1 | 6/2001 | Alvarez |
| 6,252,358 | B1 | 6/2001 | Xydis et al. |
| 6,268,600 | B1 | 7/2001 | Nakamura et al. |
| 6,273,338 | B1 | 8/2001 | White |
| 6,275,397 | B1 | 8/2001 | McClain |
| 6,283,612 | B1 | 9/2001 | Hunter |
| 6,290,140 | B1 | 9/2001 | Pesko et al. |
| 6,292,901 | B1 | 9/2001 | Lys et al. |
| 6,293,684 | B1 | 9/2001 | Riblett |
| 6,297,724 | B1 | 10/2001 | Bryans et al. |
| 6,305,109 | B1 | 10/2001 | Lee |
| 6,305,821 | B1 | 10/2001 | Hsieh et al. |
| 6,307,331 | B1 | 10/2001 | Bonasia et al. |
| 6,310,590 | B1 | 10/2001 | Havel |
| 6,315,429 | B1 | 11/2001 | Grandolfo |
| 6,323,832 | B1 | 11/2001 | Nishizawa et al. |
| 6,325,651 | B1 | 12/2001 | Nishihara et al. |
| 6,334,699 | B1 | 1/2002 | Gladnick |
| 6,340,868 | B1 | 1/2002 | Lys et al. |
| 6,354,714 | B1 | 3/2002 | Rhodes |
| 6,361,186 | B1 | 3/2002 | Slayden |
| 6,362,578 | B1 | 3/2002 | Swanson et al. |
| 6,369,525 | B1 | 4/2002 | Chang et al. |
| 6,371,637 | B1 | 4/2002 | Atchinson et al. |
| 6,373,733 | B1 | 4/2002 | Wu et al. |
| 6,379,022 | B1 | 4/2002 | Amerson et al. |
| D457,667 | S | 5/2002 | Piepgras et al. |
| D457,669 | S | 5/2002 | Piepgras et al. |
| D457,974 | S | 5/2002 | Piepgras et al. |
| 6,388,393 | B1 | 5/2002 | Illingworth |
| 6,388,396 | B1 | 5/2002 | Katyl et al. |
| 6,394,623 | B1 | 5/2002 | Tsui |
| 6,396,216 | B1 | 5/2002 | Noone et al. |
| D458,395 | S | 6/2002 | Piepgras et al. |
| 6,400,096 | B1 | 6/2002 | Wells et al. |
| 6,404,131 | B1 | 6/2002 | Kawano et al. |
| 6,411,022 | B1 | 6/2002 | Machida |
| 6,411,045 | B1 | 6/2002 | Nerone |
| 6,422,716 | B2 | 7/2002 | Henrici et al. |
| 6,428,189 | B1 | 8/2002 | Hochstein |
| 6,429,604 | B1 | 8/2002 | Chang |
| D463,610 | S | 9/2002 | Piepgras et al. |
| 6,445,139 | B1 | 9/2002 | Marshall et al. |
| 6,448,550 | B1 | 9/2002 | Nishimura |
| 6,448,716 | B1 | 9/2002 | Hutchison |
| 6,459,919 | B1 | 10/2002 | Lys et al. |
| 6,464,373 | B1 | 10/2002 | Petrick |
| 6,469,457 | B2 | 10/2002 | Callahan |
| 6,471,388 | B1 | 10/2002 | Marsh |
| 6,472,823 | B2 | 10/2002 | Yen |
| 6,473,002 | B1 | 10/2002 | Hutchison |
| D468,035 | S | 12/2002 | Blanc et al. |
| 6,488,392 | B1 | 12/2002 | Lu |
| 6,495,964 | B1 | 12/2002 | Muthu et al. |
| 6,511,204 | B2 | 1/2003 | Emmel et al. |
| 6,517,218 | B2 | 2/2003 | Hochstein |
| 6,521,879 | B1 | 2/2003 | Rand et al. |
| 6,522,078 | B1 | 2/2003 | Okamoto et al. |
| 6,527,411 | B1 | 3/2003 | Sayers |
| 6,528,954 | B1 | 3/2003 | Lys et al. |
| 6,528,958 | B2 | 3/2003 | Hulshof et al. |
| 6,538,375 | B1 | 3/2003 | Duggal et al. |
| 6,540,381 | B1 | 4/2003 | Douglas, II |
| 6,541,800 | B2 | 4/2003 | Barnett et al. |

(56) References Cited

U.S. PATENT DOCUMENTS

| | | | |
|---|---|---|---|
| 6,548,967 | B1 | 4/2003 | Dowling et al. |
| 6,568,834 | B1 | 5/2003 | Scianna |
| 6,573,536 | B1 | 6/2003 | Dry |
| 6,577,072 | B2 | 6/2003 | Saito et al. |
| 6,577,080 | B2 | 6/2003 | Lys et al. |
| 6,577,512 | B2 | 6/2003 | Tripathi et al. |
| 6,577,794 | B1 | 6/2003 | Currie et al. |
| 6,578,979 | B2 | 6/2003 | Truttmann-Battig |
| 6,582,103 | B1 | 6/2003 | Popovich et al. |
| 6,583,550 | B2 | 6/2003 | Iwasa et al. |
| 6,583,573 | B2 | 6/2003 | Bierman |
| D477,093 | S | 7/2003 | Moriyama et al. |
| 6,585,393 | B1 | 7/2003 | Brandes et al. |
| 6,586,890 | B2 | 7/2003 | Min et al. |
| 6,587,049 | B1 | 7/2003 | Thacker |
| 6,590,343 | B2 | 7/2003 | Pederson |
| 6,592,238 | B2 | 7/2003 | Cleaver et al. |
| 6,594,369 | B1 | 7/2003 | Une |
| 6,596,977 | B2 | 7/2003 | Muthu et al. |
| 6,598,996 | B1 | 7/2003 | Lodhie |
| 6,608,453 | B2 | 8/2003 | Morgan et al. |
| 6,608,614 | B1 | 8/2003 | Johnson |
| 6,609,804 | B2 | 8/2003 | Nolan et al. |
| 6,609,813 | B1 | 8/2003 | Showers et al. |
| 6,612,712 | B2 | 9/2003 | Nepil |
| 6,612,717 | B2 | 9/2003 | Yen |
| 6,612,729 | B1 | 9/2003 | Hoffman |
| 6,621,222 | B1 | 9/2003 | Hong |
| 6,623,151 | B2 | 9/2003 | Pederson |
| 6,624,597 | B2 | 9/2003 | Dowling et al. |
| D481,484 | S | 10/2003 | Cuevas et al. |
| 6,634,770 | B2 | 10/2003 | Cao |
| 6,634,779 | B2 | 10/2003 | Reed |
| 6,636,003 | B2 | 10/2003 | Rahm et al. |
| 6,639,349 | B1 | 10/2003 | Bahadur |
| 6,641,284 | B2 | 11/2003 | Stopa et al. |
| 6,652,117 | B2 | 11/2003 | Tsai |
| 6,659,622 | B2 | 12/2003 | Katogi et al. |
| 6,660,935 | B2 | 12/2003 | Southard et al. |
| 6,666,689 | B1 | 12/2003 | Savage, Jr. |
| 6,667,623 | B2 | 12/2003 | Bourgault et al. |
| 6,674,096 | B2 | 1/2004 | Sommers |
| 6,676,284 | B1 | 1/2004 | Wynne |
| 6,679,621 | B2 | 1/2004 | West et al. |
| 6,681,154 | B2 | 1/2004 | Nierlich et al. |
| 6,682,205 | B2 | 1/2004 | Lin |
| 6,683,419 | B2 | 1/2004 | Kriparos |
| 6,700,136 | B2 | 3/2004 | Guida |
| 6,712,486 | B1 | 3/2004 | Popovich et al. |
| 6,717,376 | B2 | 4/2004 | Lys et al. |
| 6,717,526 | B2 | 4/2004 | Martineau et al. |
| 6,720,745 | B2 | 4/2004 | Lys et al. |
| 6,726,348 | B2 | 4/2004 | Gloisten |
| 6,736,328 | B1 | 5/2004 | Takusagawa |
| 6,736,525 | B2 | 5/2004 | Chin |
| 6,741,324 | B1 | 5/2004 | Kim |
| D491,678 | S | 6/2004 | Piepgras |
| D492,042 | S | 6/2004 | Piepgras |
| 6,744,223 | B2 | 6/2004 | Laflamme et al. |
| 6,748,299 | B1 | 6/2004 | Motoyama |
| 6,762,562 | B2 | 7/2004 | Leong |
| 6,768,047 | B2 | 7/2004 | Chang et al. |
| 6,774,584 | B2 | 8/2004 | Lys et al. |
| 6,777,891 | B2 | 8/2004 | Lys et al. |
| 6,781,329 | B2 | 8/2004 | Mueller et al. |
| 6,787,999 | B2 | 9/2004 | Stimac et al. |
| 6,788,000 | B2 | 9/2004 | Appelberg et al. |
| 6,788,011 | B2 | 9/2004 | Mueller et al. |
| 6,791,840 | B2 | 9/2004 | Chun |
| 6,796,680 | B1 | 9/2004 | Showers et al. |
| 6,799,864 | B2 | 10/2004 | Bohler et al. |
| 6,801,003 | B2 | 10/2004 | Schanberger et al. |
| 6,803,732 | B2 | 10/2004 | Kraus et al. |
| 6,806,659 | B1 | 10/2004 | Mueller et al. |
| 6,814,470 | B2 | 11/2004 | Rizkin et al. |
| 6,814,478 | B2 | 11/2004 | Menke et al. |
| 6,815,724 | B2 | 11/2004 | Dry |
| 6,846,094 | B2 | 1/2005 | Luk |
| 6,851,816 | B2 | 2/2005 | Wu et al. |
| 6,851,832 | B2 | 2/2005 | Tieszen |
| 6,853,150 | B2 | 2/2005 | Clauberg et al. |
| 6,853,151 | B2 | 2/2005 | Leong et al. |
| 6,853,563 | B1 | 2/2005 | Yang et al. |
| 6,857,924 | B2 | 2/2005 | Fu et al. |
| 6,860,628 | B2 | 3/2005 | Robertson et al. |
| 6,866,401 | B2 | 3/2005 | Sommers et al. |
| 6,869,204 | B2 | 3/2005 | Morgan et al. |
| 6,871,981 | B2 | 3/2005 | Alexanderson et al. |
| 6,874,924 | B1 | 4/2005 | Hulse et al. |
| 6,879,883 | B1 | 4/2005 | Motoyama |
| 6,883,929 | B2 | 4/2005 | Dowling |
| 6,883,934 | B2 | 4/2005 | Kawakami et al. |
| 6,888,322 | B2 | 5/2005 | Dowling et al. |
| 6,897,624 | B2 | 5/2005 | Lys et al. |
| D506,274 | S | 6/2005 | Moriyama et al. |
| 6,909,239 | B2 | 6/2005 | Gauna |
| 6,909,921 | B1 | 6/2005 | Bilger |
| 6,918,680 | B2 | 7/2005 | Seeberger |
| 6,921,181 | B2 | 7/2005 | Yen |
| 6,926,419 | B2 | 8/2005 | An |
| 6,936,968 | B2 | 8/2005 | Cross et al. |
| 6,936,978 | B2 | 8/2005 | Morgan et al. |
| 6,940,230 | B2 | 9/2005 | Myron et al. |
| 6,948,829 | B2 | 9/2005 | Verdes et al. |
| 6,953,261 | B1 | 10/2005 | Jiao et al. |
| 6,957,905 | B1 | 10/2005 | Pritchard et al. |
| 6,963,175 | B2 | 11/2005 | Archenhold et al. |
| 6,964,501 | B2 | 11/2005 | Ryan |
| 6,965,197 | B2 | 11/2005 | Tyan et al. |
| 6,965,205 | B2 | 11/2005 | Piepgras et al. |
| 6,967,448 | B2 | 11/2005 | Morgan et al. |
| 6,969,179 | B2 | 11/2005 | Sloan et al. |
| 6,969,186 | B2 | 11/2005 | Sonderegger et al. |
| 6,969,954 | B2 | 11/2005 | Lys |
| 6,975,079 | B2 | 12/2005 | Lys et al. |
| 6,979,097 | B2 | 12/2005 | Elam et al. |
| 6,982,518 | B2 | 1/2006 | Chou et al. |
| 6,995,681 | B2 | 2/2006 | Pederson |
| 6,997,576 | B1 | 2/2006 | Lodhie et al. |
| 6,999,318 | B2 | 2/2006 | Newby |
| 7,004,603 | B2 | 2/2006 | Knight |
| D518,218 | S | 3/2006 | Roberge et al. |
| 7,008,079 | B2 | 3/2006 | Smith |
| 7,014,336 | B1 | 3/2006 | Duchame et al. |
| 7,015,650 | B2 | 3/2006 | McGrath |
| 7,018,063 | B2 | 3/2006 | Michael et al. |
| 7,018,074 | B2 | 3/2006 | Raby et al. |
| 7,021,799 | B2 | 4/2006 | Mizuyoshi |
| 7,021,809 | B2 | 4/2006 | Iwasa et al. |
| 7,024,256 | B2 | 4/2006 | Krzyzanowski et al. |
| 7,029,145 | B2 | 4/2006 | Frederick |
| 7,031,920 | B2 | 4/2006 | Dowling et al. |
| 7,033,036 | B2 | 4/2006 | Pederson |
| 7,038,398 | B1 | 5/2006 | Lys et al. |
| 7,038,399 | B2 | 5/2006 | Lys et al. |
| 7,042,172 | B2 | 5/2006 | Dowling et al. |
| 7,048,423 | B2 | 5/2006 | Stepanenko et al. |
| 7,049,761 | B2 | 5/2006 | Timmermans et al. |
| 7,052,171 | B1 | 5/2006 | Lefebvre et al. |
| 7,053,557 | B2 | 5/2006 | Cross et al. |
| 7,064,498 | B2 | 6/2006 | Dowling et al. |
| 7,064,674 | B2 | 6/2006 | Pederson |
| 7,067,992 | B2 | 6/2006 | Leong et al. |
| 7,077,978 | B2 | 7/2006 | Setlur et al. |
| 7,080,927 | B2 | 7/2006 | Feuerborn et al. |
| 7,086,747 | B2 | 8/2006 | Nielson et al. |
| 7,088,014 | B2 | 8/2006 | Nierlich et al. |
| 7,088,904 | B2 | 8/2006 | Ryan, Jr. |
| 7,102,902 | B1 | 9/2006 | Brown et al. |
| 7,113,541 | B1 | 9/2006 | Lys et al. |
| 7,114,830 | B2 | 10/2006 | Robertson et al. |
| 7,114,834 | B2 | 10/2006 | Rivas et al. |
| 7,118,262 | B2 | 10/2006 | Negley |
| 7,119,503 | B2 | 10/2006 | Kemper |

(56) References Cited

U.S. PATENT DOCUMENTS

| | | | |
|---|---|---|---|
| 7,120,560 | B2 | 10/2006 | Williams et al. |
| 7,121,679 | B2 | 10/2006 | Fujimoto |
| 7,122,976 | B1 | 10/2006 | Null et al. |
| 7,123,139 | B2 | 10/2006 | Sweeney |
| 7,128,442 | B2 | 10/2006 | Lee et al. |
| 7,128,454 | B2 | 10/2006 | Kim et al. |
| D532,532 | S | 11/2006 | Maxik |
| 7,132,635 | B2 | 11/2006 | Dowling |
| 7,132,785 | B2 | 11/2006 | Duchame |
| 7,132,804 | B2 | 11/2006 | Lys et al. |
| 7,135,824 | B2 | 11/2006 | Lys et al. |
| 7,139,617 | B1 | 11/2006 | Morgan et al. |
| 7,144,135 | B2 | 12/2006 | Martin et al. |
| 7,153,002 | B2 | 12/2006 | Kim et al. |
| 7,161,311 | B2 | 1/2007 | Mueller et al. |
| 7,161,313 | B2 | 1/2007 | Piepgras et al. |
| 7,161,556 | B2 | 1/2007 | Morgan et al. |
| 7,164,110 | B2 | 1/2007 | Pitigoi-Aron et al. |
| 7,164,235 | B2 | 1/2007 | Ito et al. |
| 7,164,863 | B2 | 1/2007 | Thomas et al. |
| 7,165,866 | B2 | 1/2007 | Li |
| 7,167,777 | B2 | 1/2007 | Budike, Jr. |
| 7,168,843 | B2 | 1/2007 | Striebel |
| D536,468 | S | 2/2007 | Crosby |
| 7,178,941 | B2 | 2/2007 | Roberge et al. |
| 7,180,252 | B2 | 2/2007 | Lys et al. |
| D538,950 | S | 3/2007 | Maxik |
| D538,952 | S | 3/2007 | Maxik et al. |
| D538,962 | S | 3/2007 | Elliott |
| 7,186,003 | B2 | 3/2007 | Dowling et al. |
| 7,186,005 | B2 | 3/2007 | Hulse |
| 7,187,141 | B2 | 3/2007 | Mueller et al. |
| 7,190,126 | B1 | 3/2007 | Paton |
| 7,192,154 | B2 | 3/2007 | Becker |
| 7,198,387 | B1 | 4/2007 | Gloisten et al. |
| 7,201,491 | B2 | 4/2007 | Bayat et al. |
| 7,201,497 | B2 | 4/2007 | Weaver, Jr. et al. |
| 7,202,613 | B2 | 4/2007 | Morgan et al. |
| 7,204,615 | B2 | 4/2007 | Arik et al. |
| 7,204,622 | B2 | 4/2007 | Dowling et al. |
| 7,207,696 | B1 | 4/2007 | Lin |
| 7,210,818 | B2 | 5/2007 | Luk et al. |
| 7,210,957 | B2 | 5/2007 | Mrakovich et al. |
| 7,211,959 | B1 | 5/2007 | Chou |
| 7,213,934 | B2 | 5/2007 | Zarian et al. |
| 7,217,004 | B2 | 5/2007 | Park et al. |
| 7,217,012 | B2 | 5/2007 | Southard et al. |
| 7,217,022 | B2 | 5/2007 | Ruffin |
| 7,218,056 | B1 | 5/2007 | Harwood |
| 7,218,238 | B2 | 5/2007 | Right et al. |
| 7,220,015 | B2 | 5/2007 | Dowling |
| 7,220,018 | B2 | 5/2007 | Crabb et al. |
| 7,221,104 | B2 | 5/2007 | Lys et al. |
| 7,221,110 | B2 | 5/2007 | Sears et al. |
| 7,224,000 | B2 | 5/2007 | Aanegola et al. |
| 7,226,189 | B2 | 6/2007 | Lee et al. |
| 7,228,052 | B1 | 6/2007 | Lin |
| 7,228,190 | B2 | 6/2007 | Dowling et al. |
| 7,231,060 | B2 | 6/2007 | Dowling et al. |
| 7,233,115 | B2 | 6/2007 | Lys |
| 7,233,831 | B2 | 6/2007 | Blackwell |
| 7,236,366 | B2 | 6/2007 | Chen |
| 7,237,924 | B2 | 7/2007 | Marineau et al. |
| 7,237,925 | B2 | 7/2007 | Mayer et al. |
| 7,239,523 | B1 | 7/2007 | Hsu et al. |
| 7,241,038 | B2 | 7/2007 | Naniwa et al. |
| 7,242,152 | B2 | 7/2007 | Dowling et al. |
| 7,244,058 | B2 | 7/2007 | DiPenti et al. |
| 7,246,926 | B2 | 7/2007 | Harwood |
| 7,246,931 | B2 | 7/2007 | Hseih et al. |
| 7,248,239 | B2 | 7/2007 | Dowling et al. |
| 7,249,269 | B1 | 7/2007 | Motoyama |
| 7,249,865 | B2 | 7/2007 | Robertson |
| D548,868 | S | 8/2007 | Roberge et al. |
| 7,252,408 | B2 | 8/2007 | Mazzochette et al. |
| 7,253,566 | B2 | 8/2007 | Lys et al. |
| 7,255,457 | B2 | 8/2007 | Ducharme et al. |
| 7,255,460 | B2 | 8/2007 | Lee |
| 7,256,554 | B2 | 8/2007 | Lys |
| 7,258,458 | B2 | 8/2007 | Mochiachvili et al. |
| 7,258,467 | B2 | 8/2007 | Saccomanno et al. |
| 7,259,528 | B2 | 8/2007 | Pilz |
| 7,262,439 | B2 | 8/2007 | Setlur et al. |
| 7,262,559 | B2 | 8/2007 | Tripathi et al. |
| D550,379 | S | 9/2007 | Hoshikawa et al. |
| 7,264,372 | B2 | 9/2007 | Maglica |
| 7,267,467 | B2 | 9/2007 | Wu et al. |
| 7,270,443 | B2 | 9/2007 | Kurtz et al. |
| 7,271,794 | B1 | 9/2007 | Cheng et al. |
| 7,273,300 | B2 | 9/2007 | Mrakovich |
| 7,274,045 | B2 | 9/2007 | Chandran et al. |
| 7,274,160 | B2 | 9/2007 | Mueller et al. |
| D553,267 | S | 10/2007 | Yuen |
| 7,285,801 | B2 | 10/2007 | Eliashevich et al. |
| 7,288,902 | B1 | 10/2007 | Melanson |
| 7,288,904 | B2 | 10/2007 | Numeroli et al. |
| 7,296,912 | B2 | 11/2007 | Beauchamp |
| 7,300,184 | B2 | 11/2007 | Ichikawa et al. |
| 7,300,192 | B2 | 11/2007 | Mueller et al. |
| D556,937 | S | 12/2007 | Ly |
| D557,854 | S | 12/2007 | Lewis |
| 7,303,300 | B2 | 12/2007 | Dowling et al. |
| 7,306,353 | B2 | 12/2007 | Popovich et al. |
| 7,307,391 | B2 | 12/2007 | Shan |
| 7,308,296 | B2 | 12/2007 | Lys et al. |
| 7,309,965 | B2 | 12/2007 | Dowling et al. |
| 7,318,658 | B2 | 1/2008 | Wang et al. |
| 7,319,244 | B2 | 1/2008 | Liu et al. |
| 7,319,246 | B2 | 1/2008 | Soules et al. |
| 7,321,191 | B2 | 1/2008 | Setlur et al. |
| 7,326,964 | B2 | 2/2008 | Lim et al. |
| 7,327,281 | B2 | 2/2008 | Hutchison |
| 7,329,024 | B2 | 2/2008 | Lynch et al. |
| 7,329,031 | B2 | 2/2008 | Liaw et al. |
| D563,589 | S | 3/2008 | Hariri et al. |
| 7,344,278 | B2 | 3/2008 | Paravantsos |
| 7,345,320 | B2 | 3/2008 | Dahm |
| 7,348,604 | B2 | 3/2008 | Matheson |
| 7,350,936 | B2 | 4/2008 | Ducharme et al. |
| 7,350,952 | B2 | 4/2008 | Nishigaki |
| 7,352,138 | B2 | 4/2008 | Lys et al. |
| 7,352,339 | B2 | 4/2008 | Morgan et al. |
| 7,353,071 | B2 | 4/2008 | Blackwell et al. |
| 7,358,679 | B2 | 4/2008 | Lys et al. |
| 7,358,929 | B2 | 4/2008 | Mueller et al. |
| 7,370,986 | B2 | 5/2008 | Chan |
| 7,374,327 | B2 | 5/2008 | Schexnaider |
| 7,378,805 | B2 | 5/2008 | Oh et al. |
| 7,378,976 | B1 | 5/2008 | Paterno |
| 7,385,359 | B2 | 6/2008 | Dowling et al. |
| 7,391,159 | B2 | 6/2008 | Harwood |
| 7,396,142 | B2 | 7/2008 | Laizure, Jr. et al. |
| 7,396,146 | B2 | 7/2008 | Wang |
| 7,401,935 | B2 | 7/2008 | VanderSchuit |
| 7,401,945 | B2 | 7/2008 | Zhang |
| D576,749 | S | 9/2008 | Kitagawa et al. |
| 7,423,548 | B2 | 9/2008 | Kontovich |
| 7,427,840 | B2 | 9/2008 | Morgan et al. |
| 7,429,117 | B2 | 9/2008 | Pohlert et al. |
| 7,434,964 | B1 | 10/2008 | Zheng et al. |
| 7,438,441 | B2 | 10/2008 | Sun et al. |
| D580,089 | S | 11/2008 | Ly et al. |
| D581,556 | S | 11/2008 | To et al. |
| 7,449,847 | B2 | 11/2008 | Schanberger et al. |
| D582,577 | S | 12/2008 | Yuen |
| 7,466,082 | B1 | 12/2008 | Snyder et al. |
| 7,470,046 | B2 | 12/2008 | Kao et al. |
| D584,428 | S | 1/2009 | Li et al. |
| D584,429 | S | 1/2009 | Pei et al. |
| 7,476,002 | B2 | 1/2009 | Wolf et al. |
| 7,476,004 | B2 | 1/2009 | Chan |
| 7,478,924 | B2 | 1/2009 | Robertson |
| 7,482,764 | B2 | 1/2009 | Morgan et al. |
| D586,484 | S | 2/2009 | Liu et al. |

(56) References Cited

U.S. PATENT DOCUMENTS

| | | | |
|---|---|---|---|
| D586,928 | S | 2/2009 | Liu et al. |
| 7,490,957 | B2 | 2/2009 | Leong et al. |
| 7,494,246 | B2 | 2/2009 | Harbers et al. |
| 7,497,596 | B2 | 3/2009 | Ge |
| 7,498,753 | B2 | 3/2009 | McAvoy et al. |
| 7,507,001 | B2 | 3/2009 | Kit |
| 7,510,299 | B2 | 3/2009 | Timmermans et al. |
| 7,510,400 | B2 | 3/2009 | Glovatsky et al. |
| 7,511,613 | B2 | 3/2009 | Wang |
| 7,514,876 | B2 | 4/2009 | Roach, Jr. |
| 7,520,635 | B2 | 4/2009 | Wolf et al. |
| 7,521,872 | B2 | 4/2009 | Bruning |
| 7,524,089 | B2 | 4/2009 | Park |
| D592,766 | S | 5/2009 | Zhu et al. |
| D593,223 | S | 5/2009 | Komar |
| 7,530,701 | B2 | 5/2009 | Chan-Wing |
| 7,534,002 | B2 | 5/2009 | Yamaguchi et al. |
| D594,999 | S | 6/2009 | Uchida et al. |
| 7,549,769 | B2 | 6/2009 | Kim et al. |
| 7,556,396 | B2 | 7/2009 | Kuo et al. |
| 7,559,663 | B2 | 7/2009 | Wong et al. |
| 7,562,998 | B1 | 7/2009 | Yen |
| D597,686 | S | 8/2009 | Noh |
| 7,569,981 | B1 | 8/2009 | Ciancanelli |
| 7,572,030 | B2 | 8/2009 | Booth et al. |
| 7,575,339 | B2 | 8/2009 | Hung |
| 7,579,786 | B2 | 8/2009 | Soos |
| 7,583,035 | B2 | 9/2009 | Shteynberg et al. |
| 7,583,901 | B2 | 9/2009 | Nakagawa et al. |
| 7,592,757 | B2 | 9/2009 | Hargenrader et al. |
| 7,594,738 | B1 | 9/2009 | Lin et al. |
| D601,726 | S | 10/2009 | Mollaert et al. |
| 7,598,681 | B2 | 10/2009 | Lys et al. |
| 7,598,684 | B2 | 10/2009 | Lys et al. |
| 7,600,907 | B2 | 10/2009 | Liu et al. |
| 7,602,559 | B2 | 10/2009 | Jang et al. |
| 7,616,849 | B1 | 11/2009 | Simon |
| 7,618,157 | B1 | 11/2009 | Galvez et al. |
| 7,619,366 | B2 | 11/2009 | Diederiks |
| 7,635,201 | B2 | 12/2009 | Deng |
| 7,635,214 | B2 | 12/2009 | Perlo |
| 7,639,517 | B2 | 12/2009 | Zhou et al. |
| 7,648,251 | B2 | 1/2010 | Whitehouse et al. |
| D610,724 | S | 2/2010 | Chiang et al. |
| 7,654,703 | B2 | 2/2010 | Kan et al. |
| 7,661,839 | B2 | 2/2010 | Tsai |
| D611,172 | S | 3/2010 | Lin et al. |
| D612,528 | S | 3/2010 | McGrath et al. |
| 7,690,813 | B2 | 4/2010 | Kanamori et al. |
| 7,710,047 | B2 | 5/2010 | Shteynberg et al. |
| 7,710,253 | B1 | 5/2010 | Fredricks |
| 7,712,918 | B2 | 5/2010 | Siemiet et al. |
| 7,748,886 | B2 | 7/2010 | Pazula et al. |
| 7,758,207 | B1 | 7/2010 | Zhou et al. |
| 7,759,881 | B1 | 7/2010 | Melanson |
| D621,975 | S | 8/2010 | Wang |
| 7,784,966 | B2 | 8/2010 | Verfuerth et al. |
| 7,800,511 | B1 | 9/2010 | Hutchison et al. |
| 7,815,338 | B2 | 10/2010 | Siemiet et al. |
| 7,815,341 | B2 | 10/2010 | Steedly et al. |
| 7,828,471 | B2 | 11/2010 | Lin |
| 7,843,150 | B2 | 11/2010 | Wang et al. |
| 7,848,702 | B2 | 12/2010 | Ho et al. |
| 7,850,341 | B2 | 12/2010 | Mrakovich et al. |
| 7,855,641 | B1 | 12/2010 | Okafo |
| RE42,161 | E | 2/2011 | Hochstein |
| 7,878,683 | B2 | 2/2011 | Logan et al. |
| 7,887,216 | B2 | 2/2011 | Patrick |
| 7,887,226 | B2 | 2/2011 | Huang et al. |
| 7,889,051 | B1 | 2/2011 | Billig et al. |
| D634,452 | S | 3/2011 | de Visser |
| 7,904,209 | B2 | 3/2011 | Podgomy et al. |
| D636,504 | S | 4/2011 | Duster |
| 7,926,975 | B2 | 4/2011 | Siemiet et al. |
| 7,938,562 | B2 | 5/2011 | Ivey et al. |
| 7,946,729 | B2 | 5/2011 | Ivey et al. |
| 7,976,185 | B2 | 7/2011 | Uang et al. |
| 7,976,196 | B2 | 7/2011 | Ivey et al. |
| 7,990,070 | B2 | 8/2011 | Nerone |
| 7,997,770 | B1 | 8/2011 | Meurer |
| 8,013,472 | B2 | 9/2011 | Adest et al. |
| D650,097 | S | 12/2011 | Trumble et al. |
| D650,494 | S | 12/2011 | Tsao et al. |
| D652,968 | S | 1/2012 | Aguiar et al. |
| 8,093,823 | B1 | 1/2012 | Ivey et al. |
| D654,192 | S | 2/2012 | Maxik et al. |
| 8,118,447 | B2 | 2/2012 | Simon et al. |
| 8,136,738 | B1 | 3/2012 | Kopp |
| 8,159,152 | B1 | 4/2012 | Salessi |
| D660,472 | S | 5/2012 | Aguiar et al. |
| 8,167,452 | B2 | 5/2012 | Chou |
| 8,177,388 | B2 | 5/2012 | Yen |
| 8,179,037 | B2 | 5/2012 | Chan et al. |
| 8,183,989 | B2 | 5/2012 | Tsai |
| D662,236 | S | 6/2012 | Matsushita |
| 8,203,445 | B2 | 6/2012 | Recker et al. |
| 8,214,084 | B2 | 7/2012 | Ivey et al. |
| 8,230,690 | B1 | 7/2012 | Salessi |
| 8,247,985 | B2 | 8/2012 | Timmermans et al. |
| 8,251,544 | B2 | 8/2012 | Ivey et al. |
| 8,262,249 | B2 | 9/2012 | Hsia et al. |
| 8,272,764 | B2 | 9/2012 | Son |
| 8,287,144 | B2 | 10/2012 | Pedersen et al. |
| 8,297,788 | B2 | 10/2012 | Bishop |
| 8,299,722 | B2 | 10/2012 | Melanson |
| 8,304,993 | B2 | 11/2012 | Tzou et al. |
| 8,313,213 | B2 | 11/2012 | Lin et al. |
| 8,319,407 | B2 | 11/2012 | Ke |
| 8,319,433 | B2 | 11/2012 | Lin et al. |
| 8,319,437 | B2 | 11/2012 | Carlin et al. |
| 8,322,878 | B2 | 12/2012 | Hsia et al. |
| 8,324,817 | B2 | 12/2012 | Ivey et al. |
| 8,337,071 | B2 | 12/2012 | Negley et al. |
| 8,366,291 | B2 | 2/2013 | Hoffmann |
| 8,376,579 | B2 | 2/2013 | Chang |
| 8,376,588 | B2 | 2/2013 | Yen |
| 8,382,322 | B2 | 2/2013 | Bishop |
| 8,382,327 | B2 | 2/2013 | Timmermans et al. |
| 8,382,502 | B2 | 2/2013 | Cao et al. |
| 8,398,275 | B2 | 3/2013 | Wang et al. |
| 8,403,692 | B2 | 3/2013 | Cao et al. |
| 8,405,314 | B2 | 3/2013 | Jensen |
| 8,434,914 | B2 | 5/2013 | Li et al. |
| 8,454,193 | B2 | 6/2013 | Simon et al. |
| 8,496,351 | B2 | 7/2013 | Lo et al. |
| 8,523,394 | B2 | 9/2013 | Simon et al. |
| 8,531,109 | B2 | 9/2013 | Visser et al. |
| 8,571,716 | B2 | 10/2013 | Ivey et al. |
| 8,628,216 | B2 | 1/2014 | Ivey et al. |
| 8,653,984 | B2 | 2/2014 | Ivey et al. |
| 8,870,412 | B1 | 10/2014 | Timmermans et al. |
| 9,016,895 | B2 | 4/2015 | Handsaker |
| 9,253,040 | B2 | 2/2016 | Pitchers |
| 10,278,247 | B2 | 4/2019 | Ivey et al. |
| 2001/0015297 | A1 | 8/2001 | Harle |
| 2001/0033488 | A1 | 10/2001 | Chliwnyj et al. |
| 2001/0045803 | A1 | 11/2001 | Cencur |
| 2002/0011801 | A1 | 1/2002 | Chang |
| 2002/0015297 | A1 | 2/2002 | Hayashi et al. |
| 2002/0038157 | A1 | 3/2002 | Dowling et al. |
| 2002/0041159 | A1 | 4/2002 | Kaping |
| 2002/0044006 | A1 | 4/2002 | Dowling et al. |
| 2002/0044066 | A1 | 4/2002 | Dowling et al. |
| 2002/0047516 | A1 | 4/2002 | Iwasa et al. |
| 2002/0047569 | A1 | 4/2002 | Dowling et al. |
| 2002/0047624 | A1 | 4/2002 | Stam et al. |
| 2002/0047628 | A1 | 4/2002 | Morgan et al. |
| 2002/0048169 | A1 | 4/2002 | Dowling et al. |
| 2002/0057061 | A1 | 5/2002 | Mueller et al. |
| 2002/0060526 | A1 | 5/2002 | Timmermans et al. |
| 2002/0070688 | A1 | 6/2002 | Dowling et al. |
| 2002/0074559 | A1 | 6/2002 | Dowling et al. |
| 2002/0074958 | A1 | 6/2002 | Crenshaw |
| 2002/0078221 | A1 | 6/2002 | Blackwell et al. |

(56) References Cited

U.S. PATENT DOCUMENTS

2002/0101197 A1 8/2002 Lys et al.
2002/0113555 A1 8/2002 Lys et al.
2002/0130627 A1 9/2002 Morgan et al.
2002/0145394 A1 10/2002 Morgan et al.
2002/0145869 A1 10/2002 Dowling
2002/0152045 A1 10/2002 Dowling
2002/0152298 A1 10/2002 Kikta et al.
2002/0153851 A1 10/2002 Morgan et al.
2002/0158583 A1 10/2002 Lys et al.
2002/0163316 A1 11/2002 Lys et al.
2002/0171365 A1 11/2002 Morgan et al.
2002/0171377 A1 11/2002 Mueller et al.
2002/0171387 A1 11/2002 Morgan et al.
2002/0176253 A1 11/2002 Lee
2002/0176259 A1 11/2002 Ducharme
2002/0179816 A1 12/2002 Haines et al.
2002/0195975 A1 12/2002 Schanberger et al.
2003/0011538 A1 1/2003 Lys et al.
2003/0021117 A1 1/2003 Chan
2003/0028260 A1 2/2003 Blackwell et al.
2003/0031015 A1 2/2003 Ishibashi
2003/0048641 A1 3/2003 Alexanderson et al.
2003/0052599 A1 3/2003 Sun
2003/0057884 A1 3/2003 Dowling et al.
2003/0057886 A1 3/2003 Lys et al.
2003/0057887 A1 3/2003 Dowling et al.
2003/0057890 A1 3/2003 Lys et al.
2003/0076281 A1 4/2003 Morgan et al.
2003/0085710 A1 5/2003 Bourgault et al.
2003/0095404 A1 5/2003 Becks et al.
2003/0100837 A1 5/2003 Lys et al.
2003/0102810 A1 6/2003 Cross et al.
2003/0133292 A1 7/2003 Mueller et al.
2003/0137258 A1 7/2003 Piepgras et al.
2003/0185005 A1 10/2003 Sommers et al.
2003/0185014 A1 10/2003 Gloisten et al.
2003/0189412 A1 10/2003 Cunningham
2003/0218879 A1 11/2003 Tieszen
2003/0222578 A1 12/2003 Cok
2003/0222587 A1 12/2003 Dowling et al.
2003/0234342 A1 12/2003 Gaines et al.
2004/0003545 A1 1/2004 Gillespie et al.
2004/0007980 A1 1/2004 Shibata
2004/0012959 A1 1/2004 Robertson et al.
2004/0036006 A1 2/2004 Dowling
2004/0037088 A1 2/2004 English et al.
2004/0052076 A1 3/2004 Mueller et al.
2004/0062041 A1 4/2004 Cross et al.
2004/0075572 A1 4/2004 Buschmann et al.
2004/0080960 A1 4/2004 Wu
2004/0090191 A1 5/2004 Mueller et al.
2004/0090787 A1 5/2004 Dowling et al.
2004/0105261 A1 6/2004 Ducharme et al.
2004/0105264 A1 6/2004 Spero
2004/0113568 A1 6/2004 Dowling et al.
2004/0114371 A1 6/2004 Lea et al.
2004/0116039 A1 6/2004 Mueller et al.
2004/0124782 A1 7/2004 Yu
2004/0130908 A1 7/2004 McClurg et al.
2004/0130909 A1 7/2004 Mueller et al.
2004/0141321 A1 7/2004 Dowling et al.
2004/0145886 A1 7/2004 Fatemi et al.
2004/0155609 A1 8/2004 Lys et al.
2004/0160199 A1 8/2004 Morgan et al.
2004/0178751 A1 9/2004 Mueller et al.
2004/0189262 A1 9/2004 McGrath
2004/0212320 A1 10/2004 Dowling et al.
2004/0212321 A1 10/2004 Lys et al.
2004/0212993 A1 10/2004 Morgan et al.
2004/0223328 A1 11/2004 Lee et al.
2004/0240890 A1 12/2004 Lys et al.
2004/0251854 A1 12/2004 Matsuda et al.
2004/0257007 A1 12/2004 Lys et al.
2005/0013133 A1 1/2005 Yeh
2005/0023536 A1 2/2005 Shackle
2005/0024877 A1 2/2005 Frederick
2005/0030744 A1 2/2005 Ducharme et al.
2005/0035728 A1 2/2005 Schanberger et al.
2005/0036300 A1 2/2005 Dowling et al.
2005/0040774 A1 2/2005 Mueller et al.
2005/0041161 A1 2/2005 Dowling et al.
2005/0041424 A1 2/2005 Ducharme
2005/0043907 A1 2/2005 Eckel et al.
2005/0044617 A1 3/2005 Mueller et al.
2005/0047132 A1 3/2005 Dowling et al.
2005/0047134 A1 3/2005 Mueller et al.
2005/0062440 A1 3/2005 Lys et al.
2005/0063194 A1 3/2005 Lys et al.
2005/0078477 A1 4/2005 Lo
2005/0093488 A1 5/2005 Hung et al.
2005/0099824 A1 5/2005 Dowling et al.
2005/0107694 A1 5/2005 Jansen et al.
2005/0110384 A1 5/2005 Peterson
2005/0116667 A1 6/2005 Mueller et al.
2005/0128751 A1 6/2005 Roberge et al.
2005/0141225 A1 6/2005 Striebel
2005/0151489 A1 7/2005 Lys et al.
2005/0151663 A1 7/2005 Tanguay
2005/0154494 A1 7/2005 Ahmed
2005/0162093 A1 7/2005 Timmermans et al.
2005/0162100 A1 7/2005 Romano et al.
2005/0162101 A1 7/2005 Leong et al.
2005/0174473 A1 8/2005 Morgan et al.
2005/0174780 A1 8/2005 Park
2005/0184667 A1 8/2005 Sturman et al.
2005/0201112 A1 9/2005 Machi et al.
2005/0206529 A1 9/2005 St-Germain
2005/0213320 A1 9/2005 Kazuhiro et al.
2005/0213352 A1 9/2005 Lys
2005/0213353 A1 9/2005 Lys
2005/0218838 A1 10/2005 Lys
2005/0218870 A1 10/2005 Lys
2005/0219860 A1 10/2005 Schexnaider
2005/0219872 A1 10/2005 Lys
2005/0225979 A1 10/2005 Robertson et al.
2005/0231133 A1 10/2005 Lys
2005/0236029 A1 10/2005 Dowling
2005/0236998 A1 10/2005 Mueller et al.
2005/0242742 A1 11/2005 Cheang et al.
2005/0243577 A1 11/2005 Moon
2005/0248299 A1 11/2005 Chemel et al.
2005/0253533 A1 11/2005 Lys et al.
2005/0259424 A1 11/2005 Zampini et al.
2005/0264474 A1 12/2005 Rast
2005/0265019 A1 12/2005 Sommers et al.
2005/0275626 A1* 12/2005 Mueller ..... H05B 47/155
345/156
2005/0276051 A1 12/2005 Caudle et al.
2005/0276053 A1 12/2005 Nortrup et al.
2005/0276064 A1 12/2005 Wu et al.
2005/0281030 A1 12/2005 Leong et al.
2005/0285547 A1 12/2005 Piepgras et al.
2006/0002110 A1 1/2006 Dowling et al.
2006/0012987 A9 1/2006 Ducharme et al.
2006/0012997 A1 1/2006 Catalano et al.
2006/0016960 A1 1/2006 Morgan et al.
2006/0022214 A1 2/2006 Morgan et al.
2006/0028155 A1 2/2006 Young
2006/0028837 A1 2/2006 Mrakovich
2006/0034078 A1 2/2006 Kovacik et al.
2006/0044152 A1 3/2006 Wang
2006/0050509 A9 3/2006 Dowling et al.
2006/0050514 A1 3/2006 Opolka
2006/0056855 A1 3/2006 Nakagawa et al.
2006/0066447 A1 3/2006 Davenport et al.
2006/0076908 A1 4/2006 Morgan et al.
2006/0081863 A1 4/2006 Kim et al.
2006/0092640 A1 5/2006 Li
2006/0098077 A1 5/2006 Dowling
2006/0104058 A1 5/2006 Chemel et al.
2006/0109648 A1 5/2006 Trenchard et al.
2006/0109649 A1 5/2006 Ducharme et al.
2006/0109661 A1 5/2006 Coushaine et al.
2006/0126325 A1 6/2006 Lefebvre et al.

(56) References Cited

U.S. PATENT DOCUMENTS

2006/0126338 A1 6/2006 Mighetto
2006/0132061 A1 6/2006 McCormick et al.
2006/0132323 A1 6/2006 Grady
2006/0146531 A1 7/2006 Reo et al.
2006/0152172 A9 7/2006 Mueller et al.
2006/0158881 A1 7/2006 Dowling
2006/0170376 A1 8/2006 Piepgras et al.
2006/0192502 A1 8/2006 Brown et al.
2006/0193131 A1 8/2006 McGrath et al.
2006/0197661 A1 9/2006 Tracy et al.
2006/0198128 A1 9/2006 Piepgras et al.
2006/0208667 A1 9/2006 Lys et al.
2006/0215422 A1 9/2006 Laizure et al.
2006/0220595 A1 10/2006 Lu
2006/0221606 A1 10/2006 Dowling
2006/0221619 A1 10/2006 Nishigaki
2006/0227558 A1 10/2006 Osawa et al.
2006/0232974 A1 10/2006 Lee et al.
2006/0238884 A1 10/2006 Jang et al.
2006/0262516 A9 11/2006 Dowling et al.
2006/0262521 A1 11/2006 Piepgras et al.
2006/0262544 A1 11/2006 Piepgras et al.
2006/0262545 A1 11/2006 Piepgras et al.
2006/0265921 A1 11/2006 Koral et al.
2006/0273741 A1 12/2006 Stalker
2006/0274529 A1 12/2006 Cao
2006/0285325 A1 12/2006 Ducharme et al.
2007/0035255 A1 2/2007 Shuster et al.
2007/0035538 A1 2/2007 Garcia et al.
2007/0035965 A1 2/2007 Holst
2007/0040516 A1 2/2007 Chen
2007/0041220 A1 2/2007 Lynch
2007/0047227 A1 3/2007 Ducharme
2007/0053182 A1 3/2007 Robertson
2007/0053208 A1 3/2007 Justel et al.
2007/0064419 A1 3/2007 Gandhi
2007/0064425 A1 3/2007 Frecska et al.
2007/0070621 A1 3/2007 Rivas et al.
2007/0070631 A1 3/2007 Huang et al.
2007/0081423 A1 4/2007 Chien
2007/0086754 A1 4/2007 Lys et al.
2007/0086912 A1 4/2007 Dowling et al.
2007/0097678 A1 5/2007 Yang
2007/0109763 A1 5/2007 Wolf et al.
2007/0115658 A1 5/2007 Mueller et al.
2007/0115665 A1 5/2007 Mueller et al.
2007/0120463 A1 5/2007 Hayashi et al.
2007/0120594 A1 5/2007 Balakrishnan et al.
2007/0127234 A1 6/2007 Jervey
2007/0133202 A1 6/2007 Huang et al.
2007/0139938 A1 6/2007 Petroski et al.
2007/0145915 A1 6/2007 Roberge et al.
2007/0146126 A1 6/2007 Wang
2007/0147046 A1 6/2007 Arik et al.
2007/0152797 A1 7/2007 Chemel et al.
2007/0152808 A1 7/2007 Lacasse
2007/0153514 A1 7/2007 Dowling et al.
2007/0157258 A1* 7/2007 Jung ..... H04N 21/43615 725/80
2007/0159828 A1 7/2007 Wang
2007/0165402 A1 7/2007 Weaver et al.
2007/0165405 A1 7/2007 Chen
2007/0173978 A1 7/2007 Fein et al.
2007/0177382 A1 8/2007 Pritchard et al.
2007/0182387 A1 8/2007 Weirich
2007/0188114 A1 8/2007 Lys et al.
2007/0188427 A1 8/2007 Lys et al.
2007/0189026 A1 8/2007 Chemel et al.
2007/0195526 A1 8/2007 Dowling et al.
2007/0195527 A1 8/2007 Russell
2007/0195532 A1 8/2007 Reisenauer et al.
2007/0200725 A1 8/2007 Fredericks et al.
2007/0205712 A1 9/2007 Radkov et al.
2007/0206375 A1 9/2007 Piepgras et al.
2007/0211461 A1 9/2007 Harwood
2007/0211463 A1 9/2007 Chevalier et al.
2007/0228999 A1 10/2007 Kit
2007/0235751 A1 10/2007 Radkov et al.
2007/0236156 A1 10/2007 Lys et al.
2007/0236358 A1 10/2007 Street et al.
2007/0237284 A1 10/2007 Lys et al.
2007/0240346 A1 10/2007 Li et al.
2007/0241657 A1 10/2007 Radkov et al.
2007/0242466 A1 10/2007 Wu et al.
2007/0247450 A1 10/2007 Lee
2007/0247842 A1 10/2007 Zampini et al.
2007/0247847 A1 10/2007 Villard
2007/0247851 A1 10/2007 Villard
2007/0252161 A1 11/2007 Meis et al.
2007/0258231 A1 11/2007 Koerner et al.
2007/0258240 A1 11/2007 Ducharme et al.
2007/0263379 A1 11/2007 Dowling
2007/0274070 A1 11/2007 Wedell
2007/0281520 A1 12/2007 Insalaco et al.
2007/0285926 A1 12/2007 Maxik
2007/0285933 A1 12/2007 Southard et al.
2007/0290625 A1 12/2007 He et al.
2007/0291483 A1 12/2007 Lys
2007/0296350 A1 12/2007 Maxik et al.
2008/0003664 A1 1/2008 Tysoe et al.
2008/0007945 A1 1/2008 Kelly et al.
2008/0012502 A1 1/2008 Lys
2008/0012506 A1 1/2008 Mueller et al.
2008/0013316 A1 1/2008 Chiang
2008/0013324 A1 1/2008 Yu
2008/0018261 A1 1/2008 Kastner
2008/0024067 A1 1/2008 Ishibashi
2008/0037226 A1 2/2008 Shin et al.
2008/0037245 A1 2/2008 Chan
2008/0037284 A1 2/2008 Rudisill
2008/0049434 A1 2/2008 Marsh
2008/0055894 A1 3/2008 Deng
2008/0062680 A1 3/2008 Timmermans et al.
2008/0068838 A1 3/2008 Galke et al.
2008/0068839 A1 3/2008 Matheson
2008/0074872 A1 3/2008 Panotopoulos
2008/0089075 A1 4/2008 Hsu
2008/0092800 A1 4/2008 Smith et al.
2008/0093615 A1 4/2008 Lin et al.
2008/0093998 A1 4/2008 Dennery et al.
2008/0094819 A1 4/2008 Vaish
2008/0094837 A1 4/2008 Dobbins et al.
2008/0129211 A1 6/2008 Lin et al.
2008/0130267 A1 6/2008 Dowling et al.
2008/0150444 A1 6/2008 Usui et al.
2008/0151535 A1 6/2008 de Castris
2008/0157957 A1 7/2008 Pitchers
2008/0158871 A1 7/2008 McAvoy et al.
2008/0158887 A1 7/2008 Zhu et al.
2008/0164826 A1 7/2008 Lys
2008/0164827 A1 7/2008 Lys
2008/0164854 A1 7/2008 Lys
2008/0175003 A1 7/2008 Tsou et al.
2008/0180036 A1 7/2008 Garrity et al.
2008/0186704 A1 8/2008 Chou et al.
2008/0192436 A1 8/2008 Peng et al.
2008/0198598 A1 8/2008 Ward
2008/0211386 A1 9/2008 Choi et al.
2008/0211419 A1 9/2008 Garrity
2008/0218993 A1 9/2008 Li
2008/0224629 A1 9/2008 Melanson
2008/0224636 A1 9/2008 Melanson
2008/0253125 A1 10/2008 Kang et al.
2008/0258631 A1 10/2008 Wu et al.
2008/0258647 A1 10/2008 Scianna
2008/0265799 A1 10/2008 Sibert
2008/0278092 A1 11/2008 Lys et al.
2008/0285257 A1 11/2008 King
2008/0285266 A1 11/2008 Thomas
2008/0290814 A1 11/2008 Leong et al.
2008/0291675 A1 11/2008 Lin et al.
2008/0298080 A1 12/2008 Wu et al.
2008/0310119 A1 12/2008 Giacoma
2008/0315773 A1 12/2008 Pang

(56) References Cited

U.S. PATENT DOCUMENTS

2008/0315784 A1 12/2008 Tseng
2009/0002995 A1 1/2009 Lee et al.
2009/0016063 A1 1/2009 Hu
2009/0021140 A1 1/2009 Takasu et al.
2009/0046473 A1 2/2009 Tsai et al.
2009/0052186 A1 2/2009 Xue
2009/0059557 A1 3/2009 Tanaka
2009/0059559 A1 3/2009 Pabst et al.
2009/0059603 A1 3/2009 Recker et al.
2009/0067170 A1 3/2009 Bloemen et al.
2009/0067182 A1 3/2009 Hsu et al.
2009/0072945 A1 3/2009 Pan et al.
2009/0085500 A1 4/2009 Zampini et al.
2009/0086492 A1 4/2009 Meyer
2009/0091929 A1 4/2009 Faubion
2009/0091938 A1 4/2009 Jacobson et al.
2009/0101930 A1 4/2009 Li
2009/0139690 A1 6/2009 Maerz et al.
2009/0140285 A1 6/2009 Lin et al.
2009/0175041 A1 7/2009 Yuen et al.
2009/0185373 A1 7/2009 Grajcar
2009/0195186 A1 8/2009 Guest et al.
2009/0196034 A1 8/2009 Gherardini et al.
2009/0213588 A1 8/2009 Manes
2009/0219713 A1 9/2009 Siemiet et al.
2009/0230895 A1* 9/2009 De Prycker ..... H05B 47/155 315/317
2009/0231831 A1 9/2009 Hsiao et al.
2009/0268461 A1 10/2009 Deak et al.
2009/0273924 A1 11/2009 Chiang
2009/0273926 A1 11/2009 Deng
2009/0284169 A1 11/2009 Valois
2009/0290334 A1 11/2009 Ivey et al.
2009/0295776 A1 12/2009 Yu et al.
2009/0303720 A1 12/2009 McGrath
2009/0316408 A1 12/2009 Villard
2010/0008085 A1 1/2010 Ivey et al.
2010/0019689 A1 1/2010 Shan
2010/0027259 A1 2/2010 Simon et al.
2010/0033095 A1 2/2010 Sadwick
2010/0033964 A1 2/2010 Choi et al.
2010/0046222 A1 2/2010 Yang
2010/0073944 A1 3/2010 Chen
2010/0079085 A1 4/2010 Wendt et al.
2010/0096992 A1 4/2010 Yamamoto et al.
2010/0096998 A1 4/2010 Beers
2010/0103664 A1 4/2010 Simon et al.
2010/0103673 A1 4/2010 Ivey et al.
2010/0109550 A1 5/2010 Huda et al.
2010/0109558 A1 5/2010 Chew
2010/0141173 A1 6/2010 Negrete
2010/0148650 A1 6/2010 Wu et al.
2010/0149806 A1 6/2010 Yiu
2010/0157608 A1 6/2010 Chen et al.
2010/0164404 A1 7/2010 Shao et al.
2010/0181178 A1 7/2010 Chang et al.
2010/0207547 A1 8/2010 Kuroki et al.
2010/0220469 A1 9/2010 Ivey et al.
2010/0265732 A1 10/2010 Liu
2010/0270925 A1 10/2010 Withers
2010/0277069 A1 11/2010 Janik et al.
2010/0289418 A1 11/2010 Langovsky
2010/0308733 A1 12/2010 Shao
2010/0320922 A1 12/2010 Palazzolo et al.
2011/0006658 A1 1/2011 Chan et al.
2011/0057581 A1* 3/2011 Ashar ..... H05B 47/175 315/312
2011/0090682 A1 4/2011 Zheng et al.
2011/0109454 A1 5/2011 McSheffrey et al.
2011/0112661 A1 5/2011 Jung et al.
2011/0156584 A1 6/2011 Kim
2011/0176298 A1 7/2011 Meurer et al.
2011/0199723 A1 8/2011 Sato
2011/0199769 A1 8/2011 Bretschneider et al.
2011/0291588 A1 12/2011 Tagare
2012/0007511 A1* 1/2012 Choong ..... H05B 45/10 315/152
2012/0014086 A1 1/2012 Jonsson
2012/0043892 A1 2/2012 Visser et al.
2012/0063140 A1 3/2012 Kong
2012/0098439 A1 4/2012 Recker et al.
2012/0106144 A1 5/2012 Chang
2012/0113628 A1 5/2012 Burrow et al.
2012/0127726 A1 5/2012 Yen
2012/0146503 A1 6/2012 Negley et al.
2012/0147597 A1 6/2012 Farmer
2012/0153865 A1 6/2012 Rolfes et al.
2012/0155073 A1 6/2012 Mccanless et al.
2012/0161666 A1 6/2012 Antony et al.
2012/0194086 A1 8/2012 Liu et al.
2012/0195032 A1 8/2012 Shew
2012/0212951 A1 8/2012 Lai et al.
2012/0212953 A1 8/2012 Bloom et al.
2012/0230044 A1 9/2012 Zhang et al.
2012/0236533 A1 9/2012 Nakamura et al.
2012/0236554 A1 9/2012 Rust
2012/0243216 A1 9/2012 Lai et al.
2012/0243217 A1 9/2012 Szprengiel et al.
2012/0274214 A1 11/2012 Radermacher et al.
2012/0275154 A1 11/2012 Hood et al.
2012/0293991 A1 11/2012 Lin
2012/0293996 A1 11/2012 Thomas et al.
2012/0300445 A1 11/2012 Chu et al.
2012/0300468 A1 11/2012 Chang et al.
2012/0307524 A1 12/2012 Schapira et al.
2012/0320598 A1 12/2012 Son
2013/0039051 A1 2/2013 Wu
2013/0044471 A1 2/2013 Chen
2013/0044476 A1 2/2013 Bretschneider et al.
2013/0050997 A1 2/2013 Bretschneider et al.
2013/0050998 A1 2/2013 Chu et al.
2013/0057146 A1 3/2013 Chao
2013/0058079 A1 3/2013 Dellian et al.
2013/0063944 A1 3/2013 Lodhie et al.
2013/0077297 A1 3/2013 Wu et al.
2013/0094200 A1 4/2013 Dellian et al.
2013/0148349 A1 6/2013 Pasqualini et al.

FOREIGN PATENT DOCUMENTS

CN 2869556 2/2007
CN 101016976 8/2007
CN 101075605 11/2007
CN 201129681 10/2008
CN 201184574 1/2009
CN 101737664 6/2010
DE 19651140 6/1997
DE 19624087 12/1997
DE 29819966 3/1999
DE 29817609 1/2000
DE 20018865 2/2001
DE 102004035027 2/2006
EP 0013782 3/1983
EP 0091172 10/1983
EP 0124924 9/1987
EP 0174699 11/1988
EP 0197602 11/1990
EP 0714556 1/1991
EP 0214701 3/1992
EP 0262713 6/1992
EP 0203668 2/1993
EP 0272749 8/1993
EP 0337567 11/1993
EP 0390262 12/1993
EP 0359329 3/1994
EP 0403011 4/1994
EP 0632511 1/1995
EP 0432848 4/1995
EP 0659531 6/1995
EP 0403001 8/1995
EP 0525876 5/1996
EP 0889283 7/1999
EP 0458408 9/1999
EP 0578302 9/1999

(56) References Cited

FOREIGN PATENT DOCUMENTS

| | | |
|---|---|---|
| EP | 0723701 | 1/2000 |
| EP | 1142452 | 3/2001 |
| EP | 0787419 | 5/2001 |
| EP | 1016062 | 8/2002 |
| EP | 1195740 | 1/2003 |
| EP | 1149510 | 2/2003 |
| EP | 1056993 | 3/2003 |
| EP | 0766436 | 5/2003 |
| EP | 0924281 | 5/2003 |
| EP | 0826167 | 6/2003 |
| EP | 1147686 | 1/2004 |
| EP | 1145602 | 3/2004 |
| EP | 1422975 | 5/2004 |
| EP | 0890059 | 6/2004 |
| EP | 1348319 | 6/2005 |
| EP | 1037862 | 7/2005 |
| EP | 1346609 | 8/2005 |
| EP | 1321012 | 12/2005 |
| EP | 1610593 | 12/2005 |
| EP | 1624728 | 2/2006 |
| EP | 1415517 | 5/2006 |
| EP | 1415518 | 5/2006 |
| EP | 1438877 | 5/2006 |
| EP | 1166604 | 6/2006 |
| EP | 1479270 | 7/2006 |
| EP | 1348318 | 8/2006 |
| EP | 1399694 | 8/2006 |
| EP | 1461980 | 10/2006 |
| EP | 1110120 | 4/2007 |
| EP | 1440604 | 4/2007 |
| EP | 1047903 | 6/2007 |
| EP | 1500307 | 6/2007 |
| EP | 0922305 | 8/2007 |
| EP | 0922306 | 8/2007 |
| EP | 1194918 | 8/2007 |
| EP | 1833035 | 9/2007 |
| EP | 1048085 | 11/2007 |
| EP | 1852648 | 11/2007 |
| EP | 1763650 | 12/2007 |
| EP | 1459599 | 2/2008 |
| EP | 1887836 | 2/2008 |
| EP | 1579733 | 4/2008 |
| EP | 1145282 | 7/2008 |
| EP | 1157428 | 9/2008 |
| EP | 1000522 | 12/2008 |
| EP | 1502483 | 12/2008 |
| EP | 1576858 | 12/2008 |
| EP | 1646092 | 1/2009 |
| EP | 1579736 | 2/2009 |
| EP | 1889519 | 3/2009 |
| EP | 1537354 | 4/2009 |
| EP | 1518445 | 5/2009 |
| EP | 1337784 | 6/2009 |
| EP | 2013530 | 8/2009 |
| EP | 1461982 | 9/2009 |
| EP | 2430888 | 3/2012 |
| EP | 2469155 | 6/2012 |
| EP | 2573457 | 3/2013 |
| EP | 2554895 | 6/2013 |
| FR | 2813115 | 2/2002 |
| GB | 2215024 | 9/1989 |
| GB | 2324901 | 11/1998 |
| GB | 2447257 | 9/2008 |
| GB | 2472345 | 2/2011 |
| GB | 2486410 | 6/2012 |
| JP | 06-054289 | 2/1994 |
| JP | H6-54103 | 7/1994 |
| JP | 07-249467 | 9/1995 |
| JP | 7264036 | 10/1995 |
| JP | 08-162677 | 6/1996 |
| JP | 11-135274 | 5/1999 |
| JP | H11-162234 | 6/1999 |
| JP | H11-260125 | 9/1999 |
| JP | 2001-238272 | 8/2001 |
| JP | 2001-291406 | 10/2001 |
| JP | 2002-141555 | 5/2002 |
| JP | 2002-289373 | 10/2002 |
| JP | 3098271 | 2/2004 |
| JP | 2004-119078 | 4/2004 |
| JP | 2004-273234 | 9/2004 |
| JP | 2004-335426 | 11/2004 |
| JP | 2005-158363 | 6/2005 |
| JP | 2005-166617 | 6/2005 |
| JP | 2005-322866 | 11/2005 |
| JP | 2005-347214 | 12/2005 |
| JP | 2006-507641 | 3/2006 |
| JP | 2007 -227342 | 9/2007 |
| JP | 3139714 | 2/2008 |
| JP | 2008-186758 | 8/2008 |
| JP | 2008-258124 | 10/2008 |
| JP | 2008-293753 | 12/2008 |
| JP | 3154200 | 9/2009 |
| JP | 2009-283183 | 12/2009 |
| JP | 2010-192229 | 9/2010 |
| JP | 2010-205553 | 9/2010 |
| KR | 10-2004-0008244 | 1/2004 |
| KR | 10-2006-0112113 | 10/2006 |
| KR | 20-0430022 | 11/2006 |
| KR | 10-2006-0133784 | 12/2006 |
| KR | 10-2007-0063595 | 6/2007 |
| KR | 10-0781652 | 12/2007 |
| KR | 10-0844538 | 7/2008 |
| KR | 10-0888669 | 3/2009 |
| KR | 10-0927851 | 11/2009 |
| TW | M337036 | 7/2008 |
| TW | M349465 | 1/2009 |
| WO | WO 9906759 | 2/1999 |
| WO | WO 9910867 | 3/1999 |
| WO | WO 9931560 | 6/1999 |
| WO | WO 99/45312 | 9/1999 |
| WO | WO 99/57945 | 11/1999 |
| WO | WO 00/01067 | 1/2000 |
| WO | WO 02/25842 | 3/2002 |
| WO | WO 02061330 | 8/2002 |
| WO | WO 02/069306 | 9/2002 |
| WO | WO 02/091805 | 11/2002 |
| WO | WO 02/098182 | 12/2002 |
| WO | WO 02/099780 | 12/2002 |
| WO | WO 03/026358 | 3/2003 |
| WO | WO 03/055273 | 7/2003 |
| WO | WO 03/067934 | 8/2003 |
| WO | WO 03/090890 | 11/2003 |
| WO | WO 03/096761 | 11/2003 |
| WO | WO 2004/021747 | 3/2004 |
| WO | WO 2004/023850 | 3/2004 |
| WO | WO 2004/032572 | 4/2004 |
| WO | WO 2004/057924 | 7/2004 |
| WO | WO 2004/100624 | 11/2004 |
| WO | WO 2005/031860 | 4/2005 |
| WO | WO 2005/052751 | 6/2005 |
| WO | WO 2005/060309 | 6/2005 |
| WO | WO 2005/084339 | 9/2005 |
| WO | WO 2005/089293 | 9/2005 |
| WO | WO 2005/089309 | 9/2005 |
| WO | WO 2005/103555 | 11/2005 |
| WO | WO 2005/116519 | 12/2005 |
| WO | WO 2006/023149 | 3/2006 |
| WO | WO 2006/044328 | 4/2006 |
| WO | WO 2006/046207 | 5/2006 |
| WO | WO 2006/056120 | 6/2006 |
| WO | WO 2006/093889 | 9/2006 |
| WO | WO 2006/095315 | 9/2006 |
| WO | WO 2006/095316 | 9/2006 |
| WO | WO 2006/127666 | 11/2006 |
| WO | WO 2006/127785 | 11/2006 |
| WO | WO 2006/133272 | 12/2006 |
| WO | WO 2006/137686 | 12/2006 |
| WO | WO 2007/004679 | 1/2007 |
| WO | WO 2007/081674 | 7/2007 |
| WO | WO 2007/090292 | 8/2007 |
| WO | WO 2007/094810 | 8/2007 |
| WO | WO 2008/018002 | 2/2008 |
| WO | WO 2008/027093 | 3/2008 |
| WO | WO 2008/061991 | 5/2008 |

(56) References Cited

FOREIGN PATENT DOCUMENTS

| | | |
|---|---|---|
| WO | WO 2008/110978 | 9/2008 |
| WO | WO 2008/129488 | 10/2008 |
| WO | WO 2008/137460 | 11/2008 |
| WO | WO 2009/061124 | 5/2009 |
| WO | WO 2009/067074 | 5/2009 |
| WO | WO 2009/111978 | 9/2009 |
| WO | WO 2009/143047 | 11/2009 |
| WO | WO 2010/014437 | 2/2010 |
| WO | WO 2010/030509 | 3/2010 |
| WO | WO 2010/047896 | 4/2010 |
| WO | WO 2010/047898 | 4/2010 |
| WO | WO 2010/047973 | 4/2010 |
| WO | WO 2010/069983 | 6/2010 |
| WO | WO 2010/083370 | 7/2010 |
| WO | WO 2010/088105 | 8/2010 |
| WO | WO 2010/097737 | 9/2010 |
| WO | WO 2010/132625 | 11/2010 |
| WO | WO 2010/141537 | 12/2010 |
| WO | WO 2011/005562 | 1/2011 |
| WO | WO 2011/005579 | 1/2011 |
| WO | WO 2011/072308 | 6/2011 |
| WO | WO 2011/113709 | 9/2011 |
| WO | WO 2011/117059 | 9/2011 |
| WO | WO 2012/001584 | 1/2012 |
| WO | WO 2012/004708 | 1/2012 |
| WO | WO 2012/007899 | 1/2012 |
| WO | WO 2012/025626 | 3/2012 |
| WO | WO 2012/063174 | 5/2012 |
| WO | WO 2012/117018 | 9/2012 |
| WO | WO 2012/129301 | 9/2012 |
| WO | WO 2012/131522 | 10/2012 |
| WO | WO 2012/131547 | 10/2012 |
| WO | WO 2013/028965 | 2/2013 |
| WO | WO 2013/029960 | 3/2013 |
| WO | WO 2013/030128 | 3/2013 |
| WO | WO 2013/045255 | 4/2013 |
| WO | WO 2013/045439 | 4/2013 |
| WO | WO 2013/057660 | 4/2013 |
| WO | WO 2013/079242 | 6/2013 |
| WO | WO 2013/088299 | 6/2013 |
| WO | WO 2013/097823 | 7/2013 |
| WO | WO 2013/098700 | 7/2013 |

OTHER PUBLICATIONS

Best Practice Guide—Commercial Office Buildings—Central HVAC System. [online], [Retrieved on Jan. 17, 2008] Retrieved from Flex Your Power Organization web page using Internet <URL: http://www.fypower.org/bpg/module. html?b=offices&m+Central HVAC Systems&s=Contr . . . >.

Cornell University. Light Canopy—Cornell University Solar Decathlon, [online], [retrieved on Jan. 17, 2008] Retrieved from Cornell University web page using Internet <URL: http://cusd.cornell.edu/cusd/web/index.php/page/ show/section/Design/page/controls>.

D.N.A-111, [online], [retrieved Mar. 10, 2009] Retrieved from the PLC Lighting Web Page using Internet <URL: http:// www.plclighting.com/product_info. php?cPath= 1& products_ id=92>.

E20112-22 Starburst Collection, [online], [retrieved on Jul. 10, 2010] Retrieved from ET2 Contemporary Lighting using Internet <URL: http://www.et2on Ii ne_.com/proddetail .aspx?1temlD= E20112-22>.

E20116-18 Larmes Collection, [online], [retrieved on Jul. 10, 2010] Retrieved from ET2 Contemporary Lighting using Internet <URL: http://www.et2online.com/proddetail.aspx?ltemlD=E20116-18>.

E20524-10 & E20525-10 Curva Collection, [online], [retrieved on Jul. 10, 2010] Retrieved from ET2 Contemporary Lighting using Internet <URL: http://www.et2online.com/proddetail.aspx?ltem1D= E20524-10 & E20525-10>.

E20743-09 Stealth Collection, [online], [retrieved on Jul. 10, 2010] Retrieved from ET2 Contemporary Lighting using Internet <URL: http://www.et2on I ine. com/proddetail .aspx?ltemlD= E207 43-09>.

E22201-44 Esprit Collection, [online], [retrieved on Jul. 10, 2010] Retrieved from ET2 Contemporary Lighting using Internet <URL: http://www_et2online_com/proddetail_aspx?ltem1D=E22201-44>_.

Experiment Electronic Ballast Electronic Ballast for Fluorescent Lamps [online], Revised Fall of 2007. [Retrieved on Sep. 1, 1997]_ Retrieved from Virginia Tech Web Page using Internet <URL: http://www.ece.vtedu/ece3354/labs/ ballastpdf.>.

Henson, Keith. The Benefits of Building Systems Integration, Access Control & Security Systems Integration, Oct. 1, 2000, Penton Media. [online], [retrieved on Oct. 24, 2008] Retrieved from Security Solutions Web page using Internet <URL: http://securitysolutions.com/mag/security.benefits.building.systems/>.

Hightower et al, "A Survey and Taxonomy of Location Systems for Ubiquitous Computing", University of Washington, Computer Science and Engineering, Technical Report UW-CSE 01-08-03, IEEE, Aug. 24, 2001 in 29 pages.

Hightower et al., "A survey and taxonomy of location systems for Ubiquitous computing," University of Washington, Computer Science and Engineering, Technical Report UW-CSE-01-08-03, IEEE, Aug. 24, 2001, 29 pages.

Lawrence Berkeley National Labratory. Lighting Control System—Phase Cut Carrier. University of California, [online] [retrieved on Jan. 14, 2008] Retrieved from Lawrence Berkeley National Laboratory web page using Internet <URL: http://www.lbl.gov/tt/techs/lbnl1871.html>.

LCD Optics 101 Tutorial [online]. 3M Corporation, [retrieved on Jan. 6, 2010]. Retrieved from the internet: <URL: http://solutions.3m.com/wps/portal/3M/en.USNikuiti1/BrandProducts/secondary/optics101/>.

LED Lights, Replacement LED lamps for any incandescent light, [online], [retrieved on Jan. 13, 2000] Retrieved from LED Lights Web Page using Internet <URL: http://www.ledlights.com/replac.htm>.

Ledtronics, Ledtronics Catalog, 1996, p. 10, Ledtronics, Torrance, California.

Notification of Transmittal, the International Search Report and the Written Opinion of the International Searching Authority dated May 7, 2012 from the corresponding International Application No. PCT/US2011/058312.

Phason Electronic Control Systems, Light Level Controller (LLC) case study. Nov. 30, 2004. 3 pages, Phason Inc., Winnipeg, Manitoba, Canada.

Philips. Sense and Simplicity—Licensing program for LED Luminaires and Retrofits, Philips Intellectual Property & Standards, May 5, 2009.

Piper. The Best Path to Efficiency. Building Operating Management, Trade Press Publishing Company May 2000 [online], [retrieved on Jan. 17, 2008]. Retrieved from Find Articles Web Page using Internet <URL:http://findarticles.com/p/articles/mi.qu3922/is.200005/ai.n8899499/>.

PLC-81756-AL "Fireball" Contemporary Pendant Light, [on line], [retrieved on Feb. 27, 2009] Retrieved from the Arcadian Lighting Web Page using Internet <URL: http://www.arcadianlighting.com/plc-81756-aLhtml>.

PLC-96973-PC PLC Lighting Elegance Modern/Contemporary Pendant Light, [online], [retrieved on Feb. 27, 2009] Retrieved from the Arcadian Lighting Web Page using Internet <URL: http/www.arcadianlighting.com/plc-96978-pc.html>.

Saha et al, "Location Determination of a Mobile Device using IEEE 802.11 Access Point Signals", May 5, 2002 in 20 pages.

Sensor Switch, nlight Lighting Control System, [online], [retrieved on Jan. 11, 2008] Retrieved from Sensor Switch web page using Internet <URL: http://www.sensorswitch.com>.

Six Strategies, [online], [retrieved on Jan. 11, 2008] Retrieved from Encelium Technologies Inc. Web Page using Internet <URL: http://www.encelium.com/products/strategies.html>.

Spencer, Eugene. High Sales, Low Utilization. Green Intelligent Buildings, Feb. 1, 2007. [on line]. Retrieved from Green Intelligent Buildings web page using Internet <URL: http:f/www.greenintelligentbuildings.com/CDA/I BT .Archive/SN P. GUID . 9-5-2006.A.10000000000000056772>.

(56) References Cited

OTHER PUBLICATIONS

Telecite Products & Services—Display Options, [online], [retrieved on Jan. 13, 2000] Retrieved from Telecite Web page using Internet <URL:http://www.telecite.com/en/products/options en.htm>.
Traffic Signal Products—Transportation Products Group, [online], [retrieved on Jan. 13, 2000] Retrieved from the Dialight Web Page using Internet <URL: http://www.dialightcom/trans.htm>.
Truck-Lite, LEDSelect-LED, Model 35, Clearance & Marker Lighting, [online], [retrieved on Jan. 13, 2000] Retrieved from Truck-Lite Web Page using Internet <URL: http://trucklite.com/leds14.html>.
Truck-Lite, LEDSelect-LED, Model 45, Stop, Turn & Tail Lighting [on line], [retrieved on Jan. 13, 2000] Retrieved from Truck-Lite Web Page using Internet <URL:http://trucklite.com/leds4.html>.
Truck-Lite, LEDSelect-LED, Super 44, Stop, Turn & Tail Lighting, [online], [retrieved on Jan. 13, 2000] Retrieved from Truck-Lite Web Page using Internet <URL: http://trucklite.com/leds2.html>_.
Wolsey, Robert Interoperable Systems: The Future of Lighting Control, Lighting Research Center, Jan. 1, 1997, vol. 2 No. 2, Rensselaer Polytechnic Institute, Troy, New York [online]. Retrieved Lighting Research Center Web Page using Internet <URL: http://www.lrc.rpi.edu/programs/Futures/LF-BAS/index.asp>.
Examination and Search Report dated Jul. 2, 2012 in cooresponding United Kingdom Application No. 1018896.9 in 4 pages.
Extended European Search Report for co-pending European Application No. 09822425.6 dated Aug. 30, 2012 in 9 pages.
Extended European Search Report for co-pending European Application No. 10732124 dated Dec. 13, 2012 in 8 pages.
Extended European Search Report for co-pending European Application No. 10736237.8 dated Oct. 19, 2012 in 5 pages.
Extended European Search Report for co-pending European Application No. 10738925.6 dated Oct. 1, 2012 in 7 pages.
Extended European Search Report for co-pending European Application No. 10797596.3 dated Jan. 17, 2013 in 11pages.
International Report on Patentability dated May 24, 2010 from the corresponding International Application No. PCT/ US2009/060087 filed Oct. 9, 2009.
International Search Report and Written Opinion dated Jan. 4, 2010 from the corresponding International Application No. PCT/US2009/044313 filed May 18, 2009.
International Search Report and Written Opinion dated Feb. 7, 2011 from the corresponding International Application No. PCT/US2010/039678 filed Jun. 23, 2010.
International Search Report and Written Opinion dated May 7, 2010 from the corresponding International Application No. PCT/US2009/057109 filed on Sep. 16, 2009.
International Search Report and Written Opinion dated Apr. 8, 2010 from the corresponding International Application No. PCT/2009/055114 filed on Aug. 27, 2009.
International Search Report and Written Opinion dated Feb. 8, 2011 from the corresponding International Application No. PCT/US2010/039608 filed Jun. 23, 2010.
International Search Report and Written Opinion dated Sep. 13, 2013 for the corresponding International Application No. PCT/US2013/049425, filed Jul. 5, 2013 (AEII-4121-B-PCT).
International Search Report and Written Opinion dated Dec. 13, 2010 from the corresponding International Application No. PCT/US2010/037006 filed Jun. 2, 2010.
International Search Report and Written Opinion dated Mar. 13, 2012 from the corresponding International Application No. PCT/US2011/052995 filed on Sep. 23, 2011.
International Search Report and Written Opinion dated May 14, 2010 from the corresponding International Application No. PCT/US2009/060085 filed Oct. 9, 2009.
International Search Report and Written Opinion dated Feb. 15, 2013 from the corresponding International Application No. PCT/US2012/052244 filed on Aug. 24, 2012. (AE11-4110-B-PCT).
International Search Report and Written Opinion dated Aug. 16, 2010 from the corresponding International Application No. PCT/US2010/021131 filed on Jan. 15, 2010.
International Search Report and Written Opinion dated Jul. 16, 2009 from the corresponding International Application No. PCT/US2008/084650 filed Nov. 25, 2008.
International Search Report and Written Opinion dated Aug. 17, 2010 from the corresponding International Application No. PCT/US2010/021489 filed on Jan. 20, 2010.
International Search Report and Written Opinion dated Jul. 17, 2009 from the corresponding International Application No. PCT/US2008/085118 filed Dec. 1, 2008.
International Search Report and Written Opinion dated Nov. 21, 2011 from the corresponding International Application No. PCT/US2011/029932 filed on Mar. 25, 2011.
International Search Report and Written Opinion dated Mar. 22, 2010 from the corresponding International Application No. PCT/US2009/053853 filed Aug. 14, 2009.
International Search Report and Written Opinion dated Nov. 23, 2011 from the corresponding International Application No. PCT/US2011/042761 filed on Jul. 1, 2011.
International Search Report and Written Opinion dated Nov. 23, 2011 from the corresponding International Application No. PCT/US2011/042775 filed on Jul. 1, 2011.
International Search Report and Written Opinion dated Dec. 24, 2010 from the corresponding International Application No. PCT/US2010/034635 filed May 13, 2010.
International Search Report and Written Opinion dated May 24, 2010 from the corresponding International Application No. PCT/2009/060083 filed Oct. 9, 2009.
International Search Report and Written Opinion dated Aug. 25, 2009 from corresponding International Application No. PCT/US2009/031049 filed Jan. 15, 2009.
International Search Report and Written Opinion dated Jan. 25, 2010 from the corresponding International Application No. PCT/US2009/048623 filed Jun. 25, 2009. (AE11-351-A-PCT).
International Search Report and Written Opinion dated Feb. 26, 2010 from the corresponding International Application No. PCT/US2009/050949 filed Jul. 17, 2009.
International Search Report and Written Opinion dated Apr. 30, 2010 from the corresponding International Application No. PCT/US2009/057072 filed on Sep. 16, 2009.
International Search Report and Written Opinion dated Aug. 30, 2011 for the corresponding International Application No. PCT/US2011/029994 filed Mar. 25, 2011 (AE11-4030-B-PCT).
International Search Report and Written Opinion dated Jul. 30, 2010 from the corresponding International Application No. PCT/US2010/021448 filed on Jan. 20, 2010.
International Search Report and Written Opinion dated Sep. 30, 2011 from the corresponding International Application No. PCT/US2011/029905 filed on Mar. 25, 2011.
International Search Report and Written Opinion dated Feb. 9, 2012 from the corresponding International Application No. PCT/US2011/043524 filed on Jul. 11, 2011.
International Searching Authority dated May 7, 2012, from the corresponding International Application No. PCT/US2011/064151.
Supplementary European Search Report dated Feb. 22, 2012 from European Patent Application No. 09822424.9.
Supplementary European Search Report for corresponding European Application No. 09822381.1 dated Jan. 4, 2013 in 5 pages.
EP Office Action in the European Appln. No. 13739897.0-1203, dated Jul. 9, 2018, 6 pages.
EP Office Action in the European Appln. No. 13739897.0-1203, dated Feb. 18, 2019, 2 pages.
EP Office Action in the European Appln. No. 13739897.0-1203, dated May 20, 2019, 2 pages.
EP Office Action in the European Appln. No. 13739897.0-1203, dated May 29, 2020, 8 pages.

* cited by examiner

SYSTEM AND METHOD FOR CONTROLLING OPERATION OF AN LED-BASED LIGHT

CROSS REFERENCE TO RELATED APPLICATIONS

This application is a continuation of U.S. Utility application Ser. No. 15/712,701, filed Sep. 22, 2017, now U.S. Pat. No. 10,278,247, issued Apr. 30, 2019, which is a continuation of U.S. Utility application Ser. No. 15/008,864, filed Jan. 28, 2016, now U.S. Pat. No. 9,807,842, issued Oct. 31, 2017, which is a continuation of U.S. Utility application Ser. No. 13/934,607, filed Jul. 3, 2013, now U.S. Pat. No. 9,271,367, issued Feb. 23, 2016, which claims priority benefit to U.S. Provisional Patent Application No. 61/669,319 filed Jul. 9, 2012, the contents of which are hereby incorporated by reference in their entirety.

TECHNICAL FIELD

The embodiments disclosed herein relate in general to a light emitting diode (LED)-based light for replacing a conventional light in a standard light fixture, and in particular to a lighting control system for controlling the operation of an LED-based light.

BACKGROUND

Fluorescent lights are widely used in a variety of locations, such as schools and office buildings. Although conventional fluorescent lights have certain advantages over, for example, incandescent lights, they also pose certain disadvantages including, inter alia, disposal problems due to the presence of toxic materials within the light.

LED-based lights designed as one-for-one replacements for fluorescent lights have appeared in recent years. LED-based lights can be used in a building with a control system capable of managing various aspects of the building, including its lighting conditions. A lighting control system can be designed to regulate the lighting conditions in a building through selective control of the operation of LED-based lights, in order to, for example, improve usability of the building or to optimize its energy use. Some of these lighting control systems can remotely regulate individual lighting conditions of multiple different areas within the building. Such individualized regulation requires some form of association between each LED-based light and the particular area in which the LED-based light is positioned to illuminate. Association can entail, for example, manually assigning an LED-based light positioned to illuminate a particular area with a logical address designated within the lighting control system to correspond to that area. Once associated, the lighting control system can correctly control operation of an LED-based light based upon the desired lighting conditions for its respective area.

SUMMARY

Disclosed herein are embodiments of methods and systems for controlling operation of a light source. In one aspect, a method of associating a light source with an area for which the light source is positioned to provide lighting comprises: identifying, based on a determined physical position of a light source, one of a plurality of areas as the area for which the light source is positioned to provide lighting; identifying at least one desired lighting condition for the identified area; and controlling, using a processor, operation of the light source based on the identified at least one desired lighting condition for the identified area.

In another aspect, alighting control system comprises: a light source positioned to provide lighting for an area; and a control unit configured to: identify, based on a determined physical position of the light source, one of a plurality of areas as the area for which the light source is positioned to provide lighting, identify at least one desired lighting condition for the identified area, and control operation of the light source based on the identified at least one desired lighting condition for the identified area.

In yet another aspect, a method of selecting a lighting condition for controlling operation of a light source comprises: storing, in memory, a plurality of position-dependent lighting conditions; and selecting, using a processor in communication with the memory, one of the position-dependent lighting conditions for controlling operation of the light source based on a determined physical position of the light source, such that the operation of the light source is controlled based on the selected position-dependent lighting condition.

These and other aspects will be described in additional detail below.

BRIEF DESCRIPTION OF THE DRAWINGS

The various features, advantages and other uses of the present system and methods will become more apparent by referring to the following detailed description and drawings in which.

DETAILED DESCRIPTION

Manual association between an LED-based light and the particular area in which the LED-based light is positioned to illuminate can be time consuming and error-prone. Further, associations can be broken if a logically addressable LED-based light is moved and/or replaced during service, which can cause incorrect control over the operation of the LED-based light.

Disclosed herein are example configurations of a lighting control system for a building that can use information relating to the position of an LED-based light to associate the LED-based light with a particular area for purposes of regulating the lighting conditions for that area. Further disclosed herein are exemplary configurations of a control system that can reduce the amount of user input required to determine the information relating to the position of the LED-based light.

A building can include systems for managing various aspects of the building. These aspects can generally include the environmental conditions of the building, such as heating, ventilation and air conditioning (HVAC) conditions, security conditions and/or lighting conditions, for example. A "smart" building can include a control system, such as a building automation system, that can automatically manage the environmental conditions of the building in accordance with desired environmental conditions. Such buildings can include one or more areas located throughout the building, with each area lending itself to individualized regulation of one or more of its environmental conditions.

Figure 1:
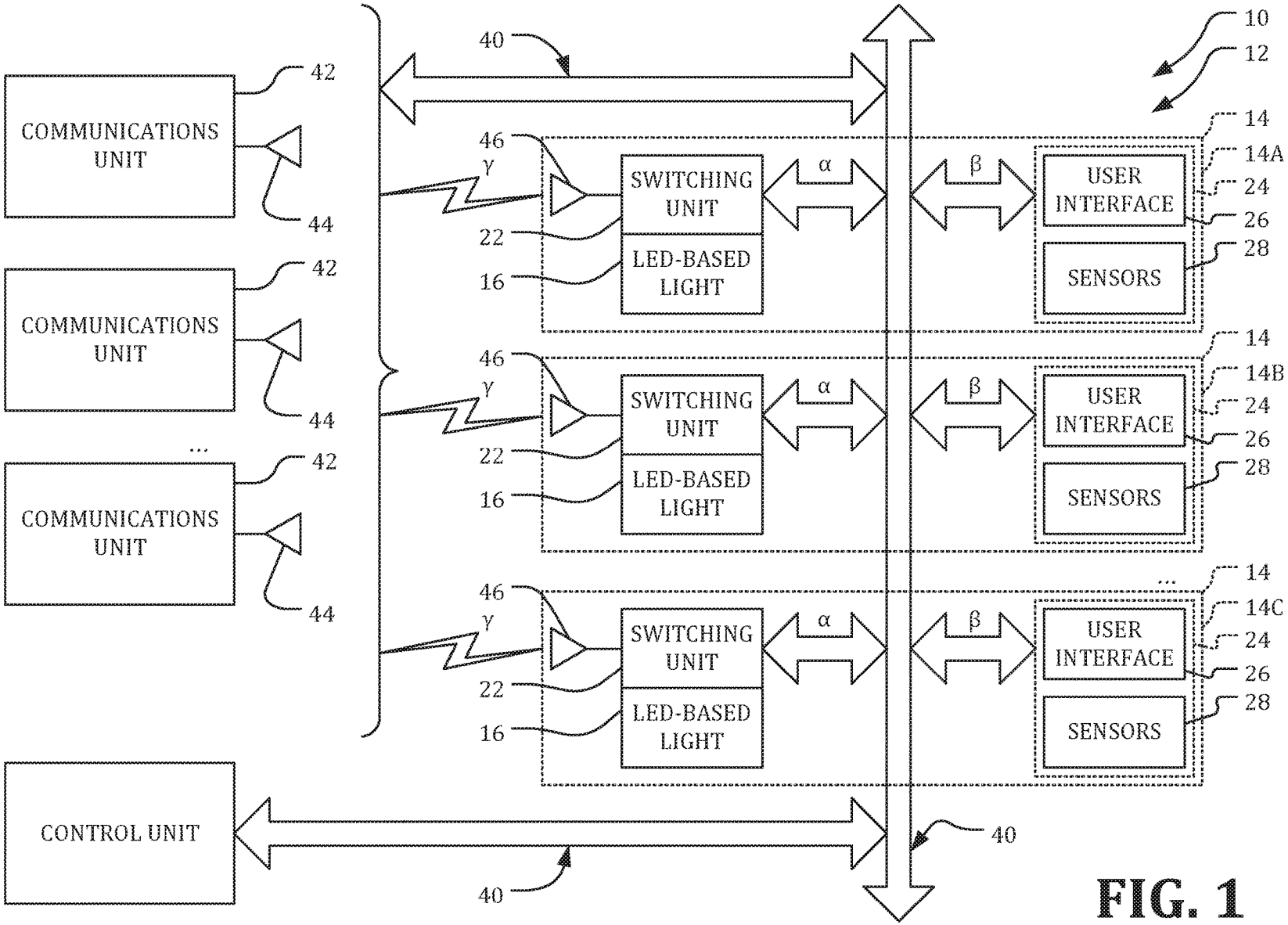
FIG. 1 is a system view of a lighting control system configured to control operation of an LED-based light.

A representative building 10 including a building automation system implementing a lighting control system 12 for regulating the lighting conditions of multiple areas 14 throughout the building 10 is shown in FIG. 1. The terms "building" and "building automation system" are used herein to describe the lighting control system 12 with reference to a representative setting in which the lighting control system 12 can be implemented. However, the lighting control system 12 could be implemented in other settings, such as outdoors, for example, or in other settings in which a number of different areas 14 lending themselves to individualized regulation with respect to their lighting conditions can be defined.

Regulation of the environmental conditions of the multiple areas 14 located throughout the building 10 can include a process of defining the areas 14 to be controlled. Each area 14, as it relates to individualized regulation of its environmental conditions, can correspond to some characteristic of the building 10 or its contents, or can correspond to some characteristic of the defined area 14. With respect to regulation of lighting conditions with the lighting control system 12, for example, the area 14 could be defined as an individual room or group of rooms located within the building 10. The area 14 could additionally or alternatively be defined in terms of its physical surroundings, such as an area adjacent to source of light extrinsic to the lighting control system 12, for instance a window supplying natural light. The area 14 could also be defined in relation to its particular functional considerations and/or constraints with respect to lighting conditions. For example, the area 14 could be defined above a workstation, or the area 14 could correspond to a particular type of room within the building 10, such as an office, a conference room, a hallway or a bathroom, for example. Similarly, the area 14 could be defined in relation to its particular requirements with respect to lighting conditions, which could involve requirements of performance lighting, efficient lighting, safety lighting, comfort lighting and/or alarm lighting, for example. As a non-limiting example, an area 14A could be an individual room located within the building 10, an area 14B could be located adjacent an east facing window receiving natural light and thereby requiring less artificial light from the lighting control system 12, and an area 14C could be located adjacent a desk or other workstation.

An area 14 could be one discrete individual location within the building 10, or could comprise some grouping of locations lending themselves to similar regulation of their environmental conditions. A building 10 could include a single area 14 or multiple areas 14, and each area 14 of a building 10 need not be defined according to an approach used to define another area 14 of the building 10. The building 10 can include more or less than the illustrated areas 14A, 14B and 14C, and the building 10 can include alternative and/or additional areas 14 depending upon which of a variety of environmental conditions is regulated. That is, with respect to regulation of environmental conditions other than lighting conditions, areas 14 could be defined within the building 10 other than as the areas 14A, 14B and 14C described above, and alternative and/or additional areas 14 could be defined for purposes of individualized regulation of the various other environmental conditions.

A building automation system for the building 10 can implement the lighting control system 12 to individually regulate the lighting conditions for each of the areas 14 located throughout the building 10. The illustrated lighting control system 12 may include one or more LED-based lights 16 positioned to illuminate each of the areas. The lighting conditions for the area 14 in which an LED-based light 16 is positioned can be regulated through selective control of the operation the LED-based light 16. For ease of understanding, the lighting control system 12 is generally described below with reference to a single LED-based light 16 positioned to illuminate a singular area 14. However, it should be understood that the lighting control system 12 can include a plurality of areas 14A, 14B and 14C, each of which can include one or more respective LED-based lights 16 positioned to illuminate the areas 14A, 14B and 14C.

The lighting control system 12 includes one or more devices for controlling the operation of the LED-based light 16. In a basic lighting system, operation of an LED-based light 16 could be controlled by electrically connecting a device such as a light switch, dimmer or other similar operator actuated device between the LED-based light 16 and a power supply. These devices control operation of the LED-based light 16 by regulating a supply of AC or DC electrical power to the LED-based light 16. For example, a supply of electrical power to the LED-based light 16 can be selectively switched to control an on/off function of the LED-based light 16, and a supply of electrical power to the LED-based light 16 can be selectively modulated to control a dimming function of the LED-based light 16.

The illustrated implementation of the lighting control system 12 includes a control unit 20 configured to control the operation of the LED-based light 16 by selectively controlling a supply of electrical power to the LED-based light 16. The control unit 20 can be or include one or more controllers configured for controlling the operation of multiple LED-based lights 16 positioned in different areas 14 located throughout the building 10. A controller could be a programmable controller, such as a microcomputer including a random access memory (RAM), a read-only memory (ROM) and a central processing unit (CPU) in addition to various input and output connections. Generally, the control functions described herein can be implemented by one or more software programs stored in internal or external memory and are performed by execution by the CPU. However, some or all of the functions could also be implemented by hardware components. Although the control unit 20 is shown and described as a single central controller for performing multiple functions related to multiple areas 14, the functions described herein could be implemented by separate controllers which collectively comprise the illustrated control unit 20.

The control unit 20 can be electrically connected between the LED-based light 16 and a power supply and configured to control operation of the LED-based light 16 by directly switching and/or modulating a supply of electrical power to LED-based light 16. Alternatively, the control unit 20 can be configured to control operation of the LED-based light 16 by indirectly controlling a supply of electrical power to the LED-based light 16, for example by communicating a control signal $\alpha$ to a switching device. For example, as shown in FIG. 1, lighting control system 12 may include a switching unit 22 communicatively coupled to the control unit 20.

The switching unit 22 is electrically connected between the LED-based light 16 and a power supply and is configured to receive the control signal $\alpha$ and, in response to the control signal α, selectively regulate a supply of electrical power to the LED-based light 16. The switching unit 22 can control an on/off function of the LED-based light 16 by including a relay or other mechanical, electrical or electro-mechanical switch configured to selectively switch a supply of electrical power to the LED-based light 16. The switching unit 22 can alternatively or additionally be or include components configured to selectively modulate a supply of electrical power to the LED-based light 16 to control a dimming function of the LED-based light 16. The switching unit 22 can selectively regulate a supply of electrical power to the LED-based light 16 to control operation of the LED-based light 16 in a variety of other manners. For example, in addition to controlling on/off and dimming functions of the LED-based light 16, the switching unit 22 can also be configured to regulate a supply of electrical power to the LED-based light 16 to achieve continuous, intermittent or other non-continuous operation of the LED-based light 16. For example, the LED-based light 16 could be operated steadily, variably, or could be blinked, flashed or amplified according to some timed pattern by the switching unit 22, depending upon the desired lighting conditions for the area 14 in which the LED-based light 16 is positioned to illuminate.

Each area 14 located throughout the building 10 can lend itself to individualized regulation of its lighting conditions in accordance with respective desired lighting conditions. The lighting control system 12 includes the control unit 20 for controlling the lighting conditions of the area 14 through selective control of the operation of the LED-based light 16 positioned to illuminate the area 14. As described above, the control unit 20 controls the operation of the LED-based light 16 by communicating a control signal α to the switching unit 22 configured to selectively regulate a supply of electrical power to the LED-based light 16. The control signal α generally corresponds to the desired lighting conditions for the area 14 in which the LED-based light 16 is positioned to illuminate. The control signal α can be representative of a setpoint illumination level for the area 14, or could be representative of some other particular requirement or characteristic with respect to the desired lighting conditions for the area 14 in which the LED-based light 16 is positioned to illuminate. For example, the control signal α could be representative of a requirement for performance lighting, efficient lighting, safety lighting, comfort lighting and/or alarm lighting in the area 14.

The control unit 20 is configured to determine the desired lighting conditions for the area 14 in which the LED-based light 16 is positioned to illuminate, and to generate the control signal α corresponding to the desired lighting conditions. The control unit 20 can generate the control signal α with logic implementing various algorithmic or heuristics techniques. As non-limiting examples, the control unit 20 can include logic implementing timers, alarms, and/or rules relating to occupancy sensing, daylight harvesting or manual override control.

The lighting control system 12 can further include one or more input devices 24 corresponding to each of the areas 14. The input devices 24 are configured to relay information relating to the actual or desired lighting conditions and/or other environmental conditions of the area 14 to the control unit 20. The lighting control system 12 can utilize the information from an input device 24 for purposes of individualized regulation of the lighting conditions for its area 14. The input devices 24 are configured to generate one or more input signals β. The input devices 24 are communicatively coupled to the control unit 20, and the logic of the control unit 20 can be responsive to the input signals β to generate the control signal α for communication to the switching unit 22.

The illustrated input devices 24 can include a user interface 26 and various sensors 28. The user interface 26 is configured to receive information from a user of the building 10 relating to requested lighting conditions for the area 14 to which the user interface 26 corresponds, and to generate corresponding input signals β for communication to the control unit 20. The user interface 26 can be or include a switch, dimmer or other user actuated device. The user interface 26 could also include a web-based or similar computer-based component for receiving information relating to requested lighting conditions for an area 14.

The lighting control system 12 can incorporate the input signals β communicated from the user interface 26 to varying degrees as compared to input signals β communicated from other input devices 24. For example, the lighting control system 12 could give priority to the user interface 26 by providing for manual override control of the operation of the LED-based light 16 on the basis of a user's actuation of the user interface 26. In this example, the control unit 20 could include logic for generating a control signal α directing the switching unit 22 to regulate a supply of electrical power to the LED-based light 16 in direct accordance with an operator's requested lighting conditions. Alternatively, the lighting control system 12 could be arranged such that a supply of electrical power to LED-based light 16 is regulated directly by the user interface 26 in accordance with an operator's requested lighting conditions without regard to a control signal α generated by the control unit 20.

The sensors 28 may be configured for measuring, monitoring and/or estimating various environmental conditions within a corresponding area 14 and for generating corresponding input signals β for communication to the control unit 20. Sensors 28 can include, for example, a sensor for measuring the actual lighting conditions of the area 14, or sensors 28 could include a sensor for monitoring or estimating occupancy of the area 14. The sensors 28 could include a motion sensor, a voice-activated sensor or a clock or calendar, for example. Similar to the input signals β from the user interface 26, the input signals β from the sensors 28 can be incorporated into the logic of the control unit 20 for generation of the control signal α.

An exemplary communications link 40 is included in the lighting control system 12 for communicatively coupling the components of the lighting control system 12. The communications link 40 may generally be configured to support digital and/or analog communication between the components included in the lighting control system 12. For example, the communications link 40 may be configured to communicatively couple the control unit 20, the switching unit 22 and the input devices 24. The communications link 40 can include wired and/or wireless communications channels using any industry standard or proprietary protocols. As a non-limiting example, a wired communications link 40 could be implemented with 0-10V signals, DALI or Ethernet. As a further non-limiting example, a wireless communications link 40 could be implemented, for example, with wireless DALI, IEEE 802.11, Wi-Fi, Bluetooth or RF channels, or through infrared, ultrasonic or modulated visible light, such as light emitted from the LED-based lights 16. Further, the communications link 40 could be implemented with multiple communications channels, each using differing protocols.

The illustrated lighting control system 12 can provide localized regulation of the lighting conditions for multiple different areas 14 with the control unit 20 by selectively controlling the operation of the respective LED-based lights 16 positioned to illuminate the respective areas 14. The control unit 20 can determine differing desired lighting conditions for each of the areas 14. For example, the desired lighting conditions for area 14A could necessitate that the LED-based light 16 positioned to illuminate area 14A be controlled to an on state, the desired lighting conditions for area 14B could necessitate that the LED-based light 16 positioned to illuminate area 14B be controlled to an off state, and the desired lighting conditions for area 14C could necessitate that the LED-based light 16 positioned to illuminate area 14C be controlled to a modulated state.

In order for the lighting control system 12 to efficiently regulate the lighting conditions in multiple areas 14, the lighting control system 12 may be configured to control the LED-based light 16 positioned to illuminate a particular area 14 without affecting the operation of LED-based lights 16 positioned to illuminate other areas 14. Proper functioning of the lighting control system 12 generally requires some association between each LED-based light 16 and the area 14 in which the LED-based light 16 is positioned to illuminate. Association can entail, for example, manually landing wires between terminals of the control unit 20 and switching units 22 and/or corresponding LED-based lights 16. Alternatively, association could entail manually assigning a switching unit 22 and/or corresponding LED-based light 16 with a logical address designated within the lighting control system 12, for example within the logic of the control unit 20, to correspond to a particular area 14. Once associated, the lighting control system 12 can control operation of an LED-based light 16 to regulate the lighting conditions for its respective area 14 according to its desired lighting conditions.

The illustrated lighting control system 12 may include a plurality of communications units 42 configured to receive information relating to the position of an LED-based light 16 within the building 10. The lighting control system 12 is configured to use the information relating to the position of the LED-based light 16 within the building 10 to associate the LED-based light 16 with the area 14 in which the LED-based light 16 is positioned to illuminate. For example, the lighting control system 12 can be configured to compare the position of an LED-based light 16 with known or determined positions of the areas 14 located throughout the building 10. The lighting control system 12 can then correlate the position of the LED-based light 16 with a particular area 14 in which the LED-based light 16 is positioned to illuminate. Once a correlation is drawn between a particular LED-based light 16 and the area 14 in which the LED-based light 16 is positioned to illuminate, the lighting control system 12 can associate the LED-based light 16 to the area 14 for purposes of future regulation of the lighting conditions for that area 14.

The communications units 42 may be communicatively coupled to the lighting control system 12 through one or more communications channels that can be included in the communications link 40. As shown in FIG. 1, the communications units 42 may be communicatively coupled to the switching units 22. Each of the communications units 42 may include a communications device 44 configured to receive a location signal γ from a communications device 46 included in the switching units 22. The communications devices 44 and 46 can be configured for communication through a communications channel implemented to communicatively couple the communications units 42 and the switching units 22, and the communications channel need not be the same as used elsewhere in the communication link 40. For example, an existing building automation system for the building 10 may already include wired communications channels for communicatively coupling the control unit 20, the switching unit 22 and the input devices 24. The building automation system for the building 10 could be retrofitted to implement the lighting control system 12 by including a wireless communications channel configured to communicatively couple the communications units 42 to the switching units 22. In this non-limiting example, the communications devices 44 and 46 can be the illustrated transceivers 44 and 46. However, the communications devices 44 and 46 could be other devices known to those skilled in the art configured to send and/or receive the location signal γ over a chosen communications channel included in the communications link 40.

As shown in FIG. 1, the communications units 42 may be communicatively coupled to switching units 22 to receive the location signal γ from the communications devices 46. The switching units 22 including the communications devices 46 can be located adjacent to or included in corresponding LED-based lights 16, such that the location signal γ conveys information generally relating to the position of the LED-based light 16. Although the communications devices 46 are described with reference to the switching units 22, the communications devices 46 could alternatively be included in the LED-based lights 16, or could be otherwise included in the lighting control system 12 according to some known or determinable spatial relationship with the LED-based light 16.

The lighting control system 12 is configured to determine, or estimate, the physical position of each of the LED-based lights 16 based at least partially upon the location signal γ. The position of an LED-based light 16 could be determined absolutely, for example, or could be determined relative to some aspect relating to the building 10 or lighting control system 12. In the exemplary implementation of the lighting control system 12, multiple communications units 42 form a spatially distributed network of communications units 42. The communications units 42 can be distributed within and/or without the building 10 to form the spatially distributed network of communications units 42. The location signal γ can be received by one or more of the communications units 42, which can be configured to determine the position of the LED-based lights 16, either individually, in some combination with each other, and/or in combination with the control unit 20 or other components of the lighting control system 12.

The lighting control system 12 can be configured to determine the position of the LED-based light 16 using various techniques, either individually or in some combination. As non-limiting examples, the position of an LED-based light 16 can be determined based upon time of arrival (TOA) of RF, infrared or ultrasonic signals, or based upon TOA of light signals, such as visible light signals emitted from the LED-based lights 16; the position of an LED-based light 16 can be determined based upon direction finding (DF) of RF, infrared or ultrasonic signals, or based upon DF of light signals, such as visible light signals emitted from the LED-based lights 16; the position of an LED-based light 16 could be determined by superimposing currents on power lines forming a power grid, or though other branch circuit monitoring methods; or the position of an LED-based light 16 could be determined by monitoring the strength of the location signal γ throughout the spatially distributed network of communications units 42. The position of an LED-based light 16 could also be determined through communication with components external from the lighting control system 12, for example by using 3g or 4g signals to communicate with global positioning systems (GPSs) or other external location systems. The position of the LED-based light 16 could also be determined more accurately through some combination of the above techniques.

Figure 2:
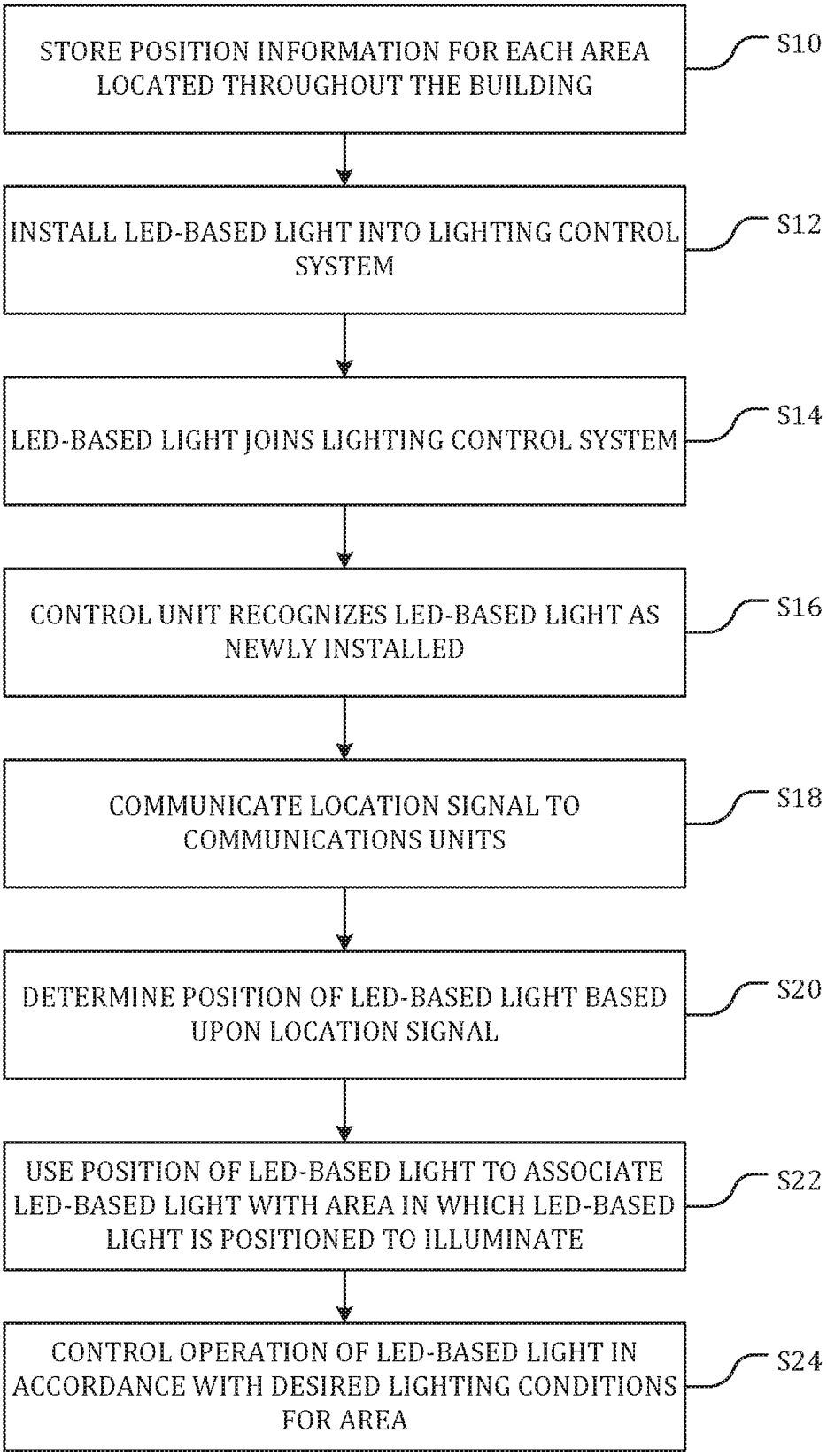
FIG. 2 is a flow chart illustrating a process including operations for installing and associating the LED-based light of FIG. 1 within the lighting control system.

A process of installing an LED-based light 16 into the lighting control system 12 of a building 10 is illustrated in FIG. 2. In step S10, information relating to the positions of each of the areas 14 located throughout the building 10 is stored in the lighting control system 12. The lighting control system 12 can be configured to know or determine the positions of each of the areas 14. Similar to the positions of the LED-based lights 16, the positions of the areas 14 could be known or determined absolutely, for example, or relative to some aspect relating to the building 10 or the lighting control system 12. For example, the physical aspects of the building 10, such as floor plans or power supply structures, could be stored in memory on the control unit 20, along with information relating to the relative positions of the areas 14 within the building 10.

In step S12, an LED-based light 16 is installed into the lighting control system 12. In step S14, the LED-based light 16 joins the lighting control system 12 by communicating with the control unit 20 through the communications link 40, and in step S16, the control unit 20 recognizes the LED-based light 16 as newly installed into (or newly positioned within) the lighting control system 12. The LED-based light 16 can have a logical address readable by the control unit 20, for example, or can be otherwise recognizable by the control unit 20 as a distinct lighting element.

In step S18, the location signal γ is communicated to the spatially distributed network of communications units 42. The location signal γ can be communicated autonomously, for example, or at the direction of the installer or at the direction of the lighting control system 12 or control unit 20. In step S20, the position of the LED-based light 16 is determined using one or more of the above described location techniques, as well as others. The logic for determining the position of the LED-based light 16 can be implemented by one or more of the communications units 42, or can be distributed between one or more of the communications units 42 and the other components of the lighting control system 12. The position of an LED-based light 16 could also be determined physically externally from the lighting control system 12, for example through communication with a GPS or other location system. The position of the newly installed LED-based 16 could also be determined and/or verified with reference to one or more LED-based lights 16 whose positions are manually determined.

In step S22, the lighting control system 12 can use the determined position of the LED-based light 16 to associate the LED-based light 16 with the area 14 in which the LED-based light 16 is positioned to illuminate. For example, the lighting control system 12 can implement logic using the control unit 20 to compare the determined position of the LED-based light 16 with the known or determined positions of the areas 14 located throughout the building 10. By correlating the determined position of the LED-based light 16 with a position of a particular area 14, the control unit 20 can determine that the LED-based light 16 is positioned to illuminate that particular area 14. Finally, in step S24, the lighting control system 12 can associate the LED-based light 16 to the area 14 within the control unit 20 for purposes of future regulation of the lighting conditions for that area 14.

Figure 3:
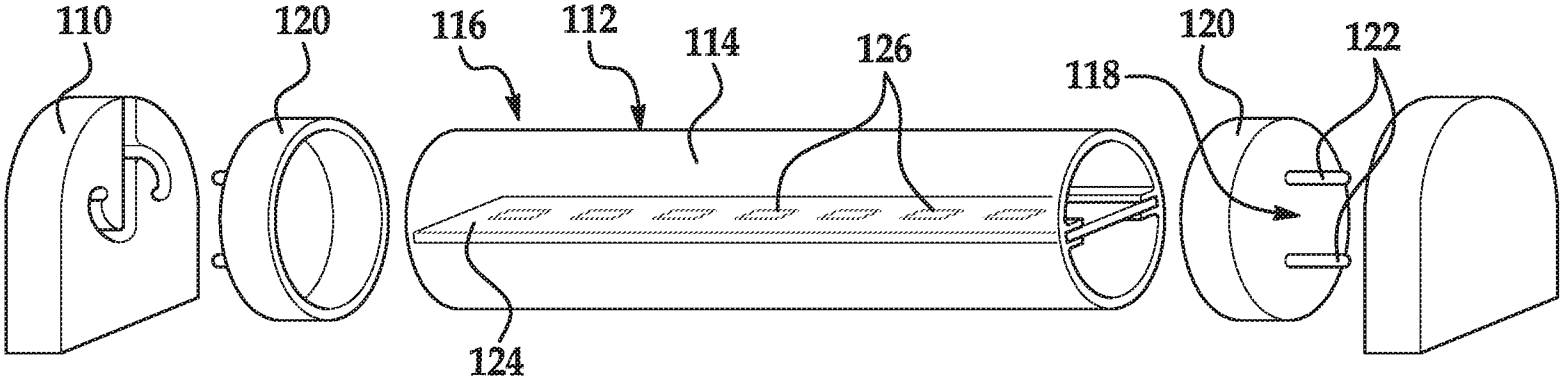
FIG. 3 is an exploded perspective view of an example of an LED-based light for use in the lighting control system of FIG. 1.

FIG. 3 illustrates an example of an LED-based light 116 for use in the lighting control system 12. The LED-based light 116 is configured to replace a conventional light in a standard light fixture 110. The light fixture 110 can be designed to accept conventional fluorescent lights, such as T5, T8 or T12 fluorescent tube lights, or can be designed to accept other standard lights, such as incandescent bulbs. The light fixture 110 could alternatively be designed to accept non-standard lights, such as lights installed by an electrician. The light fixture 110 can connect to a power supply, and can optionally include a ballast connected between the power supply and the LED-based light 116. The switching unit 22 could be compatible with the fixture 110 to electrically connect between the power supply and the LED-based light 116, or the switching unit 22 could be included in the fixture 110, for example.

In some implementations, the LED-based light 116 includes a housing 112 at least partially defined by a high dielectric light transmitting lens 114. The lens 114 can be made from polycarbonate, acrylic, glass or other light transmitting material (i.e., the lens 114 can be transparent or translucent). The term "lens" as used herein means a light transmitting structure, and not necessarily a structure for concentrating or diverging light. The LED-based light 116 can include features for uniformly distributing light to an environment to be illuminated in order to replicate the uniform light distribution of a conventional fluorescent light. For example, the lens 114 can be manufactured to include light diffracting structures, such as ridges, dots, bumps, dimples or other uneven surfaces formed on an interior or exterior of the lens 114. The light diffracting structures can be formed integrally with the lens 114, for example, by molding or extruding, or the structures can be formed in a separate manufacturing step such as surface roughening. In addition to or as an alternative to light diffracting structures, a light diffracting film can be applied to the exterior of the lens 114 or placed in the housing 112, or, the material from which the lens 114 is formed can include light refracting particles. For example, the lens 114 can be made from a composite, such as polycarbonate, with particles of a light refracting material interspersed in the polycarbonate. In other embodiments, the LED-based light 116 may not include any light diffracting structures or film.

The housing 112 can include a light transmitting tube at least partially defined by the lens 114. Alternatively, the housing 112 can be formed by attaching multiple individual parts, not all of which need be light transmitting. For example, the housing 112 can be formed in part by attaching the lens 114 to an opaque lower portion. The housing 112 can additionally include other components, such as one or more highly thermally conductive structures for enhancing heat dissipation. While the illustrated housing 112 is cylindrical, a housing having a square, triangular, polygonal, or other cross sectional shape can alternatively be used. Similarly, while the illustrated housing 112 is linear, housings having an alternative shape, e.g., a U-shape or a circular shape can alternatively be used. The LED-based light 116 can have any suitable length. For example, the LED-based light 116 may be approximately 48" long, and the housing 112 can have a 0.625", 1.0" or 1.5" diameter for engagement with a common standard fluorescent light fixture.

The LED-based light 116 can include an electrical connector 118 positioned at each end of the housing 112. In the illustrated example, the electrical connector 118 is a bi-pin connector carried by an end cap 120. A pair of end caps 120 can be attached at opposing longitudinal ends of the housing 112 for physically connecting the LED-based light 116 to a standard fluorescent light fixture 110. The end caps 120 can be the sole physical connection between the LED-based light 116 and the fixture 110. At least one of the end caps 120 can additionally electrically connect the LED-based light 116 to the fixture 110 to provide power to the LED-based light 116. Each end cap 120 can include two pins 122, although two of the total four pins can be "dummy pins" that provide physical but not electrical connection to the fixture 110. Bi-pin electrical connector 118 is compatible with many standard fluorescent fixtures, although other types of electrical connectors can be used, such as single pin connector or screw type connector.

The LED-based light 116 can include a circuit board 124 supported within the housing 112. The circuit board 124 can include at least one LED 126, a plurality of series-connected or parallel-connected LEDs 126, an array of LEDs 126 or any other arrangement of LEDs 126. Each of the illustrated LEDs 126 can include a single diode or multiple diodes, such as a package of diodes producing light that appears to an ordinary observer as coming from a single source. The LEDs 126 can be surface-mount devices of a type available from Nichia, although other types of LEDs can alternatively be used. For example, the LED-based light 116 can include high-brightness semiconductor LEDs, organic light emitting diodes (OLEDs), semiconductor dies that produce light in response to current, light emitting polymers, electro-luminescent strips (EL) or the like.

The circuit board 124 can include power supply circuitry configured to condition an input power received from, for example, the fixture 110 through the electrical connector 118 to a power usable by and suitable for the LEDs 126. In some implementations, the power supply circuitry can include one or more of an inrush protection circuit, a surge suppressor circuit, a noise filter circuit, a rectifier circuit, a main filter circuit, a current regulator circuit and a shunt voltage regulator circuit. The power supply circuitry can be suitably designed to receive a wide range of currents and/or voltages from a power source and convert them to a power usable by the LEDs 126.

The circuit board 124 is illustrated as an elongate printed circuit board. The circuit board 124 can extend a length or a partial length of the housing 112. Multiple circuit board sections can be joined by bridge connectors to create the circuit board 124. The circuit board 124 can be supported within the housing 112 through slidable engagement with a part of the housing 112, though the circuit board 124 can alternatively be clipped, adhered, snap- or friction-fit, screwed or otherwise connected to the housing 112. Also, other types of circuit boards may be used, such as a metal core circuit board. Or, instead of the circuit board 124, other types of electrical connections (e.g., wires) can be used to electrically connect the LEDs 126 to a power source.

The LEDs 126 can emit white light or light within a range of wavelengths. However, LEDs that emit blue light, ultraviolet light or other wavelengths of light can be used in place of or in combination with white light emitting LEDs 126. The number, spacing and orientation of the LEDs 126 can be a function of a length of the LED-based light 116, a desired lumen output of the LED-based light 116, the wattage of the LEDs 126 and/or the viewing angle of the LEDs 126. For a 48" LED-based light 116, the number of LEDs 126 may vary from about thirty to sixty such that the LED-based light 116 outputs approximately 3,000 lumens. However, a different number of LEDs 126 can alternatively be used, and the LED-based light 116 can output any other amount of lumens. The LEDs 126 can be evenly spaced along the circuit board 124 and arranged on the circuit board 124 to substantially fill a space along a length of the lens 114 between end caps 120 positioned at opposing longitudinal ends of the housing 112. Alternatively, single or multiple LEDs 126 can be located at one or both ends of the LED-based light 116. The LEDs 126 can be arranged in a single longitudinally extending row along a central portion of the LED circuit board 124, as shown, or can be arranged in a plurality of rows or arranged in groups. The spacing of the LEDs 126 can be determined based on, for example, the light distribution of each LED 126 and the number of LEDs 126.

Figure 4:
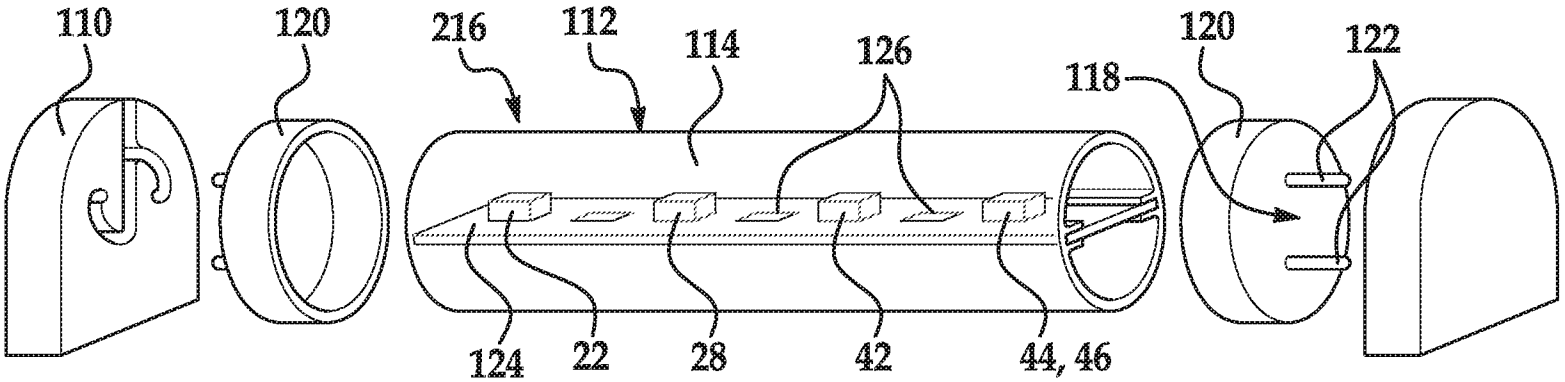
FIG. 4 is an exploded perspective view of an alternative example of an LED-based light for use in the lighting control system of FIG. 1.

An alternative example of and LED-based light 216 is shown in FIG. 4. The construction of the LED-based light 216 can be similar to the construction of the LED-based light 116 of FIG. 3, and the LED-based light 216 can include the housing 112, the lens 114, the bi-pin 122 electrical connectors 118 carried by a pair of end caps 120, the circuit board 124 and the LEDs 126.

In addition, the LED-based light 216 can incorporate one or more of the above described components of the lighting control system 12. For example, the switching unit 22 can be included the LED-based light 216. The switching unit 22 can be included in the circuit board 124 and can be electrically connected between the fixture 110 conveying electrical power from a power supply and the LEDs 126 of the LED-based light 216. The switching unit 22 of the LED-based light 216 can be configured to receive the control signal $\alpha$ and, in response to the control signal $\alpha$, selectively regulate a supply of electrical power to the LEDs 126 to control operation of the LED-based light 216.

The LED-based light 216 can also incorporate one or more of the sensors 28, for example, and can incorporate a communications unit 42 for determining the location of other LED-based lights 216. For example, multiple LED-based lights 216 including a communications unit 42 can together form the spatially distributed network of communications units 42. The positions of one or more LED-based lights 216 including a communications unit 42 can be determined manually, with the positions of the remainder of the LED-based lights 16, 116 or 216 installed into the lighting control system 12 being determined according to the process and techniques described above. In this example, the LED-based light 216 also includes communications devices 44 and/or 46 for sending and receiving location signals $\gamma$, although the LED-based light 216 could also communicate with the lighting control system 12 through the communications channels of the communications link 40.

The LED-based lights described herein are presented as examples and are not meant to be limiting. The embodiments can be used with any lighting components known to those skilled in the art and compatible with the scope of the disclosure. In addition, the disclosed processes and techniques can be applied in a variety of building automation system implemented control systems to regulate environmental conditions other than lighting conditions. For example, the disclosed processes and techniques can be applied to determine the position of printers, alarm system components and/or HVAC components, and various controllers can be control operation of these components for purpose of regulating related environmental conditions of the building 10.

While the invention has been described in connection with what is presently considered to be the most practical and preferred embodiment, it is to be understood that the invention is not to be limited to the disclosed embodiments but, on the contrary, is intended to cover various modifications and equivalent arrangements included within the scope of the appended claims, which scope is to be accorded the broadest interpretation so as to encompass all such modifications and equivalent structures as is permitted under the law.

What is claimed is:

1. A method comprising:

determining, by a control unit, data regarding a plurality of physical areas, the data comprising, for each physical area:

data describing said each physical area, and an indication of a lighting condition associated with said each physical area;

determining, by the control unit, a location of a first light source remote from the control unit based on:

a location signal associated with the first light source, one or more light signals emitted by the first light source, and a superimposition of currents on power lines forming a power grid electrically coupled to the first light source;

determining, by the control unit, that the location of the first light source is within a first physical area of the plurality of physical areas; and operating, using the control unit, the first light source to satisfy the lighting condition associated with the first physical area, wherein operating the first light source comprises transmitting one or more command signals to the first light source.

2. The method of claim 1, wherein the location signal is transmitted by a first communications device associated with the first light source to the control unit.

3. The method of claim 2, wherein the location signal is transmitted by the first communications device to the control unit via a second communication device.

4. The method of claim 1, wherein operating the first light source comprises:

receiving, at the control unit, sensor data from one or more sensors associated with the first physical area, the sensor data indicating a current physical lighting condition of the first physical area;

determining, at the control unit, that the current physical lighting condition does not satisfy the lighting condition associated with the first physical area; and responsive to determining that the current physical lighting condition does not satisfy the lighting condition associated with the first physical area, modifying a brightness of the first light source to satisfy the lighting condition associated with the first physical area.

5. The method of claim 1, wherein the sensor data signal is transmitted by the one or more sensors to the control unit via one or more communications devices.

6. The method of claim 1, further comprising:

receiving, at the control unit from a user interface, user input specifying a lighting condition associated with a particular physical area of the plurality of physical areas.

7. The method of claim 6, wherein the user interface comprises a web-based user interface presented on a computer device.

8. The method of claim 6, wherein the user interface comprises at least one of a light switch or a dimmer.

9. The method of claim 1, wherein the data describing said each physical area comprises an indication of a functional characteristic of said each physical area.

10. The method of claim 9, wherein the indication of the functional characteristic of said each physical area comprises information regarding a location of said each physical area relative to an object.

11. The method of claim 9, wherein the indication of the functional characteristic of said each physical area comprises information regarding a type of room associated with said each physical area.

12. The method of claim 11, wherein the type of room comprises at least one an office, a conference room, a hallway, or a bathroom.

13. The method of claim 1, wherein the data describing said each physical area comprises an indication of a physical surrounding of said each physical area.

14. The method of claim 1, wherein the data describing said each physical area comprises an indication of a source of natural light in proximity to said each physical area.

15. The method of claim 1, wherein the source of nature light comprises a window.

16. The method of claim 1, wherein the data describing said each physical area comprises an indication of one or more rooms associated with said each physical area.

17. The method of claim 1, wherein the indication of the lighting condition associated with said each physical area comprises an indication of a lighting performance requirement associated with said each physical area.

18. The method of claim 1, wherein the indication of the lighting condition associated with said each physical area comprises an indication of a lighting efficiency requirement associated with said each physical area.

19. The method of claim 1, wherein the indication of the lighting condition associated with said each physical area comprises an indication of a safety lighting requirement associated with said each physical area.

20. The method of claim 1, wherein the indication of the lighting condition associated with said each physical area comprises an indication of a comfort requirement associated with said each physical area.

21. The method of claim 1, wherein operating the first light comprises increasing a brightness of the first light source to satisfy the lighting condition associated with the first physical area.

22. The method of claim 1, wherein operating the first light source comprises decreasing a brightness of the first light source to satisfy the lighting condition associated with the first physical area.

23. A system comprising:

one or more processors;

one or more non-transitory computer-readable media including one or more sequences of instructions which, when executed by the one or more processors, causes:

determining, by a control unit, data regarding a plurality of physical areas, the data comprising, for each physical area:

data describing said each physical area, and an indication of a lighting condition associated with said each physical area;

determining, by the control unit, a location of a first light source remote from the control unit based on:

a location signal associated with the first light source, one or more light signals emitted by the first light source, and a superimposition of currents on power lines forming a power grid electrically coupled to the first light source;

determining, by the control unit, that the location of the first light source is within a first physical area of the plurality of physical areas; and operating, using the control unit, the first light source to satisfy the lighting condition associated with the first physical area, wherein operating the first light source comprises transmitting one or more command signals to the first light source.

24. A non-transitory computer-readable medium including one or more sequences of instructions which, when executed by one or more processors, causes:

determining, by a control unit, data regarding a plurality of physical areas, the data comprising, for each physical area:

data describing said each physical area, and an indication of a lighting condition associated with said each physical area;

determining, by the control unit, a location of a first light source remote from the control unit based on:

a location signal associated with the first light source, one or more light signals emitted by the first light source, and a superimposition of currents on power lines forming a power grid electrically coupled to the first light source;

determining, by the control unit, that the location of the first light source is within a first physical area of the plurality of physical areas; and operating, using the control unit, the first light source to satisfy the lighting condition associated with the first physical area, wherein operating the first light source comprises transmitting one or more command signals to the first light source.

25. The method of claim 1, wherein the one or more light signals comprise one or more infrared signals, and wherein the location of the first light source is determined based on the one or more infrared signals.

26. The method of claim 1, wherein the one or more light signals comprise one or more visible light signals, and wherein the location of the first light source is determined based on the one or more visible light signals.

27. The method of claim 1, wherein determining the location of the first light source comprises determining a time of flight of the one or more light signals.

28. The method of claim 1, wherein determining the location of the first light source comprises performing direction finding based on the one or more light signals.

29. The method of claim 1, wherein determining the location of the first light source comprises:

monitoring one or more branch circuits of the power grid.

* * * * *